US005765059A

United States Patent [19]

Kosuge et al.

[11] Patent Number: 5,765,059

[45] Date of Patent: Jun. 9, 1998

[54] DEVELOPING DEVICE FOR IMAGE FORMING APPARATUS AND TONER CONTAINER THEREFOR

[75] Inventors: Katsuhiro Kosuge, Tokyo; Tomoji Ishikawa; Kazuyuki Sugihara, both of Yokohama, all of Japan

[73] Assignee: Ricoh Company, Ltd., Tokyo, Japan

[21] Appl. No.: 459,424

[22] Filed: Jun. 2, 1995

[30] Foreign Application Priority Data

| | | | |
|---|---|---|---|
| Jun. 2, 1994 | [JP] | Japan | 6-145698 |
| Jun. 2, 1994 | [JP] | Japan | 6-145699 |
| Jun. 5, 1994 | [JP] | Japan | 6-147179 |
| May 10, 1995 | [JP] | Japan | 7-137386 |

[51] Int. Cl.[6] ..... G03G 15/06

[52] U.S. Cl. ..... 399/224; 399/227; 399/262

[58] Field of Search ..... 399/226, 227, 399/224, 262, 258

[56] References Cited

U.S. PATENT DOCUMENTS

| | | | |
|---|---|---|---|
| 4,212,264 | 7/1980 | Knechtel et al. . | |
| 4,850,303 | 7/1989 | Cipolla et al. . | |
| 4,975,748 | 12/1990 | Koinuma et al. . | |
| 5,034,776 | 7/1991 | Sugiura . | |
| 5,053,825 | 10/1991 | Trainor et al. . | |
| 5,105,226 | 4/1992 | Sugihara . | |
| 5,109,254 | 4/1992 | Oka et al. . | |
| 5,268,719 | 12/1993 | Rydelek et al. | 399/226 |
| 5,384,628 | 1/1995 | Takami et al. . | |
| 5,416,568 | 5/1995 | Yoshiki et al. . | |
| 5,537,197 | 7/1996 | Fujishiro et al. | 399/228 |
| 5,552,877 | 9/1996 | Ishikawa et al. | 399/227 |
| 5,565,973 | 10/1996 | Fujishiro et al. | 399/227 |
| 5,587,783 | 12/1996 | Nakamura et al. | 355/326 R |

FOREIGN PATENT DOCUMENTS

| | | |
|---|---|---|
| 0 225 745 | 6/1987 | European Pat. Off. . |
| 0 541 379 | 5/1993 | European Pat. Off. . |
| 61-117575 | 6/1986 | Japan . |
| 62-55679 | 3/1987 | Japan . |
| 62-121471 | 6/1987 | Japan . |
| 2-78962 U | 6/1990 | Japan . |

OTHER PUBLICATIONS

Patent Abstracts of Japan, vol. 15, No. 471, Nov. 28, 1991, JP-A-3-203760, Sep. 5, 1991.

Patent Abstracts of Japan, vol. 18, Jan. 7, 1994, JP-A-5-249766, Sep. 28, 1993.

Patent Abstracts of Japan, vol. 11, No. 239, Aug. 6, 1987, JP-A-62-50862, Mar. 5, 1987.

*Primary Examiner*—Nestor R. Ramirez

*Attorney, Agent, or Firm*—Oblon, Spivak, McClelland, Maier & Neustadt, P.C.

[57] ABSTRACT

In an image forming apparatus, a developing device has a toner container having a toner outlet, and a receptacle having a mount portion for removably mounting the container. The insertion space of the mount portion and the toner outlet are each tapered such that the width in the up-and-down direction sequentially decreases toward the deepest end. In a developing device of the type causing the container to be rotated to bring the toner outlet into alignment with a toner inlet formed in the receptacle, the edge portion of the toner outlet is tapered to reduce a load during rotation and to ensure close contact at the end of the mounting of the container.

6 Claims, 17 Drawing Sheets

DEVELOPING DEVICE FOR IMAGE FORMING APPARATUS AND TONER CONTAINER THEREFOR

BACKGROUND OF THE INVENTION

The present invention relates to a developing device for a copier, facsimile apparatus, printer or similar image forming apparatus and, more particularly, to, in a developing device of the type having a developing chamber and a removable toner container storing toner to be replenished into the chamber, an improvement in the mounting and dismounting procedure of the container and an improvement in the replenishment of the toner from the container into a hopper.

Conventional developing devices having a single developing chamber include one which allows a toner container, storing toner to be replenished into the chamber, to be slid into or out of the device body. This kind of device is taught in, for example, Japanese Utility Model Laid-Open Publication No. 2-78962 and will be referred to as Prior Art 1.

Another conventional device having a single developing chamber is constructed such that a toner container is mounted to the mount portion of the device body and then rotated in the mount portion to bring a toner outlet thereof into alignment with a toner inlet formed in the mount portion.

This kind of device will be referred to as Prior Art 2.

Japanese Patent Laid-Open Publication No. 3-2883, for example, discloses a developer supply device having a hollow cylindrical developer container. The container is provided with a developer outlet and a drive connecting portion at one end of its circumferential wall. An axial spiral groove is formed in the inner periphery of the container. The developer is conveyed to a developing section along a preselected path by conveying means. A holding portion supports the container inserted thereinto and includes a receptacle portion for guiding the developer from the developer outlet to the preselected path. A drive section delivers a torque to the container inserted in the holding portion by way of the drive connecting portion. This device will be referred to as Prior Art 3.

A developing device having a plurality of developing chambers is also conventional and applicable to a full-color image forming apparatus of the type exposing an image carrier with color-separated image light, developing the resulting latent images by toner of colors complementary to the separated colors, and then transferring toner images to a single paper one above the other. This kind of device will be referred to as Prior Art 4. The developing chambers may be arranged in parallel around the image carrier as independent units. Alternatively, the developing chambers may be arranged at preselected circumferential positions in a rotary support facing the image carrier. The rotary support, or revolver, is rotatable to sequentially move its chambers to a developing position where the image carrier is located. The revolver is made up of a rotary developing unit, a rotary toner storing unit, and toner conveying means. The developing unit is rotatable in the vicinity of a photoconductive drum, or image carrier, and has a plurality of developing chambers thereinside. The storing unit is coaxially provided on one end of the developing unit. A plurality of storing chambers are defined in the storing unit in one-to-one correspondence with the developing chambers, and each stores toner of particular color. Each storing chamber is communicated to one of the developing chambers by the conveying means. For this kind of revolver, a reference may be made to, for example, Japanese patent Laid-Open Publication Nos. 62-251772 and 63-78170, and Japanese Utility Model Laid-Open Publication No. 63-41164.

There has also been proposed a revolver similar to the above-described type of revolver except that a plurality of hopper portions are substituted for the storing chambers and connected to the associated developing chambers by respective toner conveying means. A toner container storing toner of particular color is removably mounted to a toner inlet formed in each hopper portion. The hopper portions are affixed to the base plate of the developing unit, and each has its edge portion configured as a mount portion for mounting the container. The mount portion and the edge portion allow the container to be slid into or out of the hopper portion in the axial direction of the developing unit. This revolver will be referred to as Prior Art 5.

Prior Art 5 also proposes to form at the center of the developing unit a bore open at the toner storing unit side, and to store black toner, which is used most often, in a hollow cylindrical container having a greater capacity than color toner containers. The black container is mounted to the toner storing unit with its rear end received in the bore. The black container is provided with a spiral ridge on the inner periphery thereof for conveying the toner, and a toner outlet at one end of its circumferential wall. The toner outlet corresponds to a toner inlet formed in the hopper portion. When the developing unit and toner storing unit are rotated integrally, the black toner in the container is conveyed to the outlet and then dropped into the inlet of the hopper portion by gravity.

In Prior Art 4, each toner container should be replaced when it runs out of the toner. However, because the time when the toner is used up differs from one container to another container, it is preferable that each container can be replaced independently of each other. In light of this, there has been proposed a revolver in which the toner storing unit is provided with mount portions each accommodating one end of the associated toner conveying means and causing its toner inlet to face upward when the associated developing chamber is brought to a developing position. A toner container is mounted to the respective mount portion with its toner outlet facing downward. In this condition, the toner in the container is capable of flowing into the mount portion via the outlet due to its own weight. This kind of revolver will be referred to as Prior Art 6.

In Prior Art 6, the structure of the mount portion is applied only to color toner containers; a mount portion of different configuration is assigned to a black toner container provided with a greater capacity than the color toner containers. Specifically, a hollow cylindrical black toner container is formed with a toner outlet at one end of its circumferential wall and inserted into a bore formed at the center of the toner storing unit. A hopper portion is formed in the toner storing unit and provided with a toner inlet facing the outlet. The hopper portion accommodates one end of the toner conveying means and has a toner storing space of certain size. When the black toner chamber is located at the developing position, one end of the toner conveying means is positioned at the bottom of the hopper portion. when the outlet of the black toner container is brought to a higher level than the inlet by the rotation of the toner storing unit, the toner flows from the container into the hopper portion due to gravity.

The prerequisite with Prior Arts 1 and 5 is that the edge portion of the outlet of the container and that of the inlet be held in close contact with each other at the end of the movement of the container, thereby preventing the toner from flying about. To meet this requirement, an elastic seal member is adhered to at least one of the two edge portions. In addition, the edge portions are so configured as to set up a predetermined contact pressure when the two edge portions align with each other. However, when the container is slid with the edge portion of the outlet closely contacting the wall of the mount portion, a heavy load acts on the sliding movement. Further, when the two edge portions sequentially align with each other during the sliding movement, the seal member or members wear easily due to excessive rubbing. These load and wear problems are also apt to arise with Prior Art 5 when the container is slid into or out of the mount portion.

Assume that the container is inserted into the mount portion and then rotated in the mount portion to bring the toner outlet thereof into alignment with the toner inlet, as in Prior Art 2. Then, it is necessary to maintain the edge portion of the outlet and that of the inlet in close contact so as to prevent the toner from flying about. This requirement will be met if an elastic seal member is adhered to at least one of the two edges, and if the configuration of the edges and the axis of rotation are so selected as to set up a desired contact pressure when the two edges are aligned. However, when the container is rotated with the edge portion of the outlet closely contacting the wall of the mount portion, a heavy load acts on the rotation. Further, when the two edge portions sequentially align with each other during the rotation, the seal member or members wear easily due to excessive rubbing. These load and wear problems are also apt to arise with Prior Art 5 when the black toner container is rotated.

The problem with Prior Art 3 is that part of the developer around the outlet of the container is apt to rush past the outlet due to the force of the rotation. This part of the toner remains in the container until the outlet again faces downward, resulting in a low discharging efficiency. This problem is also apt to occur with Prior Art 6 in which the containers are rotated together with the developing unit and toner storing unit, and each toner is dropped from the outlet of the container by gravity.

Prior Arts 3 and 5 have another problem that when the containers are not rotated for a long period of time, the toner is apt to aggregate. When the toner aggregates to form a mass of substantial size around the toner outlet, it stops up the outlet an cannot be discharged.

Prior Art 2 has the following problems. Assume that the outlet of the black toner container is brought to a higher level than the inlet and allows the toner to flow from the container into the hopper portion due to its own weight. At this instant, despite that a space is still available in the hopper portion at a position remote from the inlet, the toner accumulating around the inlet is likely to obstruct additional toner from the container. Another problem is that when the toner should be replenished into the hopper portion during the course of usual image formation, the previously stated positional relation is apt to cause the replenishment to be short or to increase the image forming time. Specifically, during usual image formation, the replenishment is likely to be short because the container and hopper cannot be maintained at the toner replenishing position for a sufficient period of time. Increasing the period of time for them to stay at the replenishing position would increase the image forming time.

SUMMARY OF THE INVENTION

It is, therefore, an object of the present invention to provide a developing device for an image forming apparatus and of the type allowing a toner container to be slid into or out of a mount portion thereof, which device can set up a sufficient contact pressure between the edge portion of the outlet of the container and that of an inlet formed in the mount portion aligned with each other, and can obviate excessive loads on the sliding movement and rapid wear of a seal member, and a toner container therefor.

It is another object of the present invention to provide a developing device for an image forming apparatus and of the type allowing a toner container to be mounted to a mount portion thereof and then rotated to bring the outlet of the container into alignment with an inlet formed in the mount portion, which device can set up a sufficient contact pressure between the edge portion of the outlet of the container and that of an inlet formed in the mount portion aligned with each other, and can obviate excessive loads on the sliding movement and rapid wear of a seal member, and a toner container therefor.

It is another object of the present invention to provide a developing device for an image forming apparatus and of the type having a developing unit in which a plurality of developing chambers are arranged around the axis of rotation, and causing the unit to rotate about the axis to locate any one of the chambers at a developing position where an image carrier is located, which device allows at least one of the containers to rotate integrally with or independently of the unit, causes the toner to flow from the container into the associated chamber due to its own weight via an outlet formed in the circumferential wall of the container, and can prevent the toner discharging efficiency from the outlet from decreasing.

It is another object of the present invention to provide a developing device for an image forming apparatus and of the type allowing a toner container to be rotated and causing toner to drop from the container into the associated developing chamber via an outlet formed in the circumferential wall of the container and caused to face downward due to the rotation, which device can prevent the outlet from being stopped up by the toner apt to aggregate around the outlet, and a toner container therefor.

It is another object of the present invention to provide a developing device for an image forming apparatus and of the type causing a toner container to be rotated or otherwise moved integrally with a developing chamber such that an outlet thereof is located at a higher level than a toner inlet formed in a hopper portion, and thereby causing toner to drop into the hopper portion due to its own weight, which device promotes desirable replenishment of toner from the container into the hopper portion.

It is another object of the present invention to provide a developing device for an image forming apparatus and of the type having, on a path along which a developing chamber, toner container and hopper portion move, a toner replenishing position where a toner outlet is located at a higher level than a toner inlet and allows toner to flow out of a toner container into a hopper portion due to its own weight, and causing the chamber, container and hopper portion to pass through the replenishing position, which device can promote efficient toner replenishment from the container to the hopper portion while reducing the usual image forming time.

In accordance with the present invention, in a developing device having a toner container mounted and dismounted from a mount portion included in the device bodyby being slid, and storing toner to be replenished into a developing chamber, a portion of the toner container engageable with the mount portion and the mount portion are each tapered in a direction in which the toner container is slid into the mount portion.

Also, in accordance with the present invention, in a toner container storing toner to be replenished into a developing chamber of a developing device, and mounted and dismounted from a mount portion of the device body by being slid, a portion of the toner container engageable with the mount portion is tapered in a direction in which the toner container is slid into the mount portion.

Further, in accordance with the present invention, in a developing device having a toner container storing toner to be replenished into a developing chamber of the developing device, and removable from the device body, the toner container is configured such that after it has been mounted to a mount portion of the device body, it is rotated to bring its toner outlet into alignment with a toner inlet formed in the mount portion, and the edge portion of the toner outlet is tapered to sequentially approach the edge portion of the toner inlet due to the rotation of the container.

Further, in a toner container storing toner to be replenished into a developing chamber of a developing device, and rotated, after being mounted to a mount portion of the device body, to bring its toner outlet into alignment with a toner inlet formed in the mount portion, the edge portion of the toner outlet is tapered to sequentially approach the edge portion of the toner inlet due to the rotation of the container.

Further, in a developing device having a developing unit having a plurality of developing chambers arranged around the center of rotation, an causing the developing unit to rotate to locate any one of the developing chambers at a developing position, a toner container storing toner to be replenished into at least one of the developing chambers is rotatable integrally with or independently of the developing unit. The toner is dropped into the one developing chamber via a toner outlet formed in the circumferential wall of the toner container by gravity when the toner outlet faces downward. The inner surface of the toner container adjoining upstream part of the edge portion of the toner outlet in the direction of rotation is jutted toward the center line of the rotation.

Further, in a developing device having a toner container rotatably positioned and storing toner to be replenished into a developing chamber of a developing device, and causing the toner to drop into the developing chamber due to gravity via a toner outlet formed in the circumferential wall of the toner container when the toner outlet faces downward, a plate is disposed in the toner container and pivotable between a position where it extends along the inner surface of the toner container facing the toner outlet, and a position where it adjoins the toner outlet.

Furthermore, a toner container storing toner to be replenished into a developing chamber of a developing device, and formed with a toner outlet in its circumferential wall, and used after being rotated, has a plate disposed in the toner container and pivotable between a position where it extends along the inner surface of the toner container facing the toner outlet, and a position where it adjoins the toner outlet.

Moreover, in accordance with the present invention, a developing device has at least one developing chamber, a toner container storing toner to be replenished into the developing chamber, and formed with a toner outlet, a hopper portion formed with a toner inlet in its circumferential wall which the toner outlet faces, and having a predetermined space for accommodating the toner, a holding mechanism for holding the developing chamber, toner container and hopper portion integrally, and for allowing them to move along a predetermined path, a drive source for causing the developing chamber, toner container and hopper portion to move along the predetermined path, and a stopping device for stopping the movement of the developing chamber, toner container and hopper portion at a developing position where the developing chamber faces an image carrier. The inner periphery of the hopper portion is configured such that the toner near the toner inlet of the hopper portion moves to another position in the hopper portion due to gravity before a toner replenishing position where the toner outlet is higher in level than the toner inlet and causes the toner to flow into the hopper portion due to gravity is reached due to a movement caused by the drive source.

In addition, in accordance with the present invention, a developing device has at least one developing chamber, a toner container storing toner to be replenished into the developing chamber, and formed with a toner outlet, a hopper portion formed with a toner inlet in its circumferential wall which the toner outlet faces, and having a predetermined space for accommodating the toner, a holding mechanism for holding the developing chamber, toner container and hopper portion integrally, and for allowing them to move along a predetermined path, a drive source for causing the developing chamber, toner container and hopper portion to move along the predetermined path, and a stopping device for stopping the movement of the developing chamber, toner container and hopper portion at a developing position where the developing chamber faces an image carrier. A toner replenishing position where the toner outlet is located at a higher level than the toner inlet for allowing the toner to flow from the toner container into the hopper portion due to gravity is included in a movement path generated by the drive source. The developing chamber, toner container and hopper portion move to the developing position via the toner replenishing position. A toner replenishing operation for causing the developing chamber, toner container and hopper portion to replenish the toner into the hopper portion is executed by control means independently of an image forming operation.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
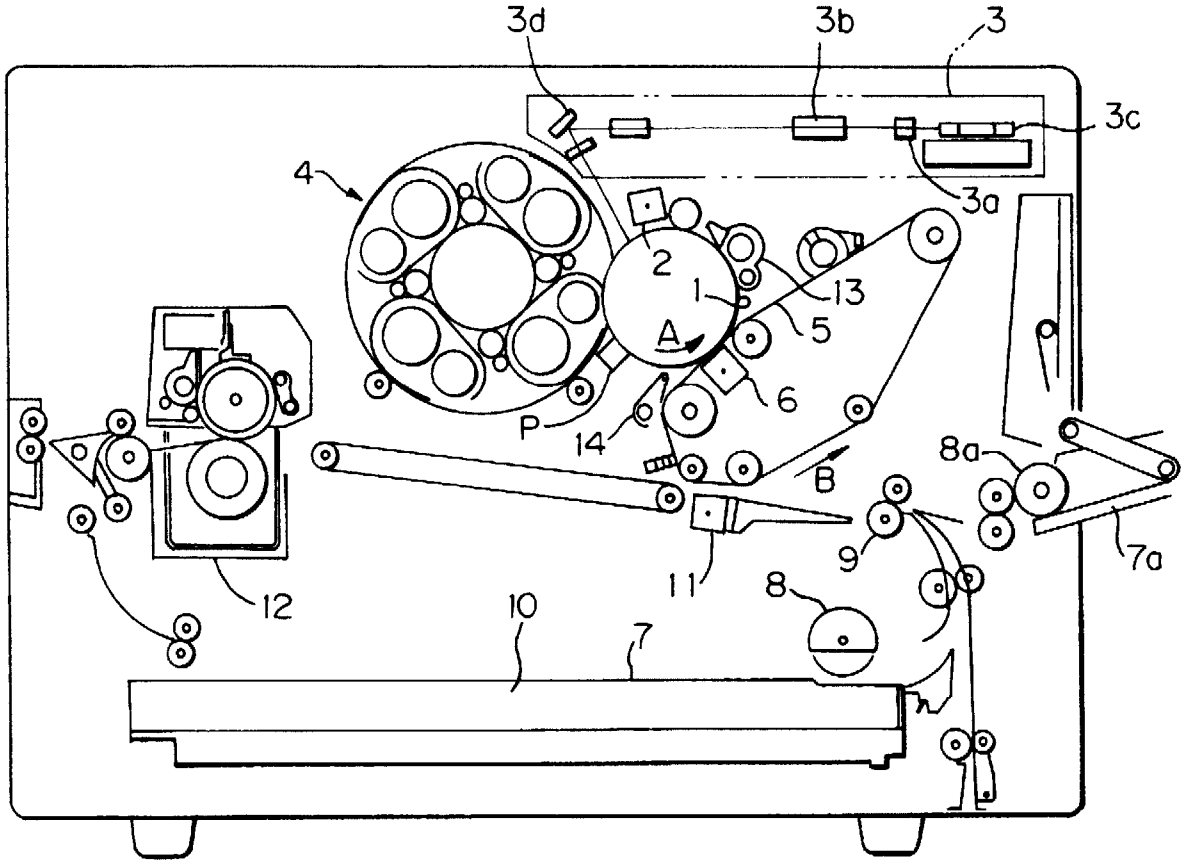
FIG. 1 is a sectional front view of an electrophotographic printer to which the present invention is applied.

Referring to FIG. 1 of the drawings, a preferred embodiment of the present invention is shown which is applied to a color electrophotographic printer. As shown, the printer has a photoconductive drum, or image carrier, 1 which is rotated in a direction indicated by an arrow in the figure. A main charger 2 uniformly charges the surface of the drum 1. Laser optics 3 scans the charged surfaces of the drum 1 in accordance with image data and thereby electrostatically forms a latent image thereon. The image data consist of yellow data, magenta data, cyan data and black data generated by separating a desired full-color image. Latent images sequentially formed on the drum 1 are each developed by one of yellow toner, magenta toner, cyan toner and black toner stored in a rotary developing device or revolver 4 which will be described. As a result, the latent images are transformed to toner images of respective colors.

An intermediate transfer belt 5 is rotated in synchronism with the drum 1 in a direction B. The toner images formed on the drum 1 are sequentially transferred to the belt 5 by a primary transfer charger 6 one above the other, thereby forming a composite color image. A paper 10 is fed from a duplex copy/automatic paper feed casette 7 or a manual paper feed tray 7*a* to an image transfer position by a pick-up roller 8 or 8*a* and a registration roller pair 9. A secondary transfer charger 11, located at the image transfer position, transfers the composite color image from the belt 5 to the paper 10. A fixing unit 12 fixes the color image on the paper 10. The paper 10 with the color image is driven out of the printer as a full-color printing. A drum cleaner 3 removes the toner remaining on the drum 1 after the image transfer. Likewise, a belt cleaner 14 removes the toner remaining on the belt 5 after the image transfer.

The revolver 4 embodying the present invention will be described with reference to FIG. 2. As shown, the revolver 4 has a substantially cylindrical developing unit 40 and a toner storing unit 45. The developing unit 40 is rotatable about its own axis and has four developing sections therein which are assigned to, for example, black, cyan, yellow, and magenta, respectively. The toner storing unit 45 is coaxial with and located at the front of the developing unit 40. Four toner containers 41, 42, 43 and 44 are removably mounted to the storing unit 45 and held in one-to-one correspondence with the four developing sections of the developing unit 40. The toner containers 41–44 store black toner, yellow toner, magenta toner, and cyan toner, respectively. The storing unit 45 is rotatable integrally with the developing unit 40. A casing 46 supports the developing unit and storing unit 45, i.e., the revolver and is slidable relative to the printer body substantially in parallel to the axis of the revolver. A cover 47, which is not rotatable, covers the storing unit 45.

Two support rollers 49, for example, are mounted on the front support wall 48 of the casing 46. The developing unit 40 has a front wall 50 and a rear wall 51 each having a disk-like configuration. The front wall 50 is supported by the support rollers 49. A tapered center shaft 52 extends out from the center of the rear wall 5 1 and rotatably received in a hole 54 formed in a rear panel 53 forming part of the printer body. In this condition, the revolver is rotatable in the printer body and positioned such that the axis thereof is parallel to the axis of the drum 1 substantially in the same plane, as shown in FIG. 1.

The casing 46 has, in addition to the front support wall 48, a rear support wall 55 and a side cover 59. The side cover 59 is affixed to the support walls 48 and 55 at opposite ends thereof and reinforced by tie rods 56, 57 and 58. An opening 60 is formed through the front support wall 48 for receiving the revolver. A motor 61 and a gear train 62 (see FIG. 3) are also mounted on the support wall 48. The motor 61 drives via the gear train 62 toner supply rollers which are disposed in the toner storing unit 45. An intermediate plate 63 is disposed in the casing 46 and supported by the tie rods 56 and 57 in the vicinity of the rear support wall 55. A positioning pin 63*b* is studded on the plate 63 and received in a positioning hole 63*a* formed in the printer rear panel 53. A bracket 64 is pivotably mounted at one end thereof on the part of the pin 63*b* intervening between the plate 63 and the rear support wall 55. A positioning roller 66 is mounted on the bracket 64. The bracket 64 is constantly biased by a spring 67 such that the roller 66 falls in any one of four recesses 65 formed in the circumference of the rear wall 51 of the developing unit 40. As a result, when one of the recesses 65 faces the roller 66, the roller 66 is surely caused to fall in the recess 65.

A front panel 68 included in the printer body is formed with an opening 69 for receiving the casing 46 carrying the revolver therewith. An upper guide 70 and a lower guide 71 extend between the printer front panel 53 and the printer rear panel. The casing 46 is slidably supported by the guides 70 and 71. Specifically, the side cover 59 of the casing 46 has portions 72 and 73 to be guided by the guides 70 and 71 at the top and the side, respectively. A channel 75 is formed in the bottom of the portion 73 and receives an upright guide pin 74 studded on the guide 71.

An output gear 78 is mounted on the printer rear panel 53 and driven by a stepping motor or similar revolver motor, not shown. The output gear 78 is held in mesh with an input gear 79 having substantially the same locus as the output gear 78. The input gear 79 is fastened to the rear of the rear wall of the developing unit 40. An output gear 81 is also mounted on the printer rear panel 53 and driven by a motor, not shown, for driving developing rollers and other rotary bodies built in the developing unit 40.

Figure 3:
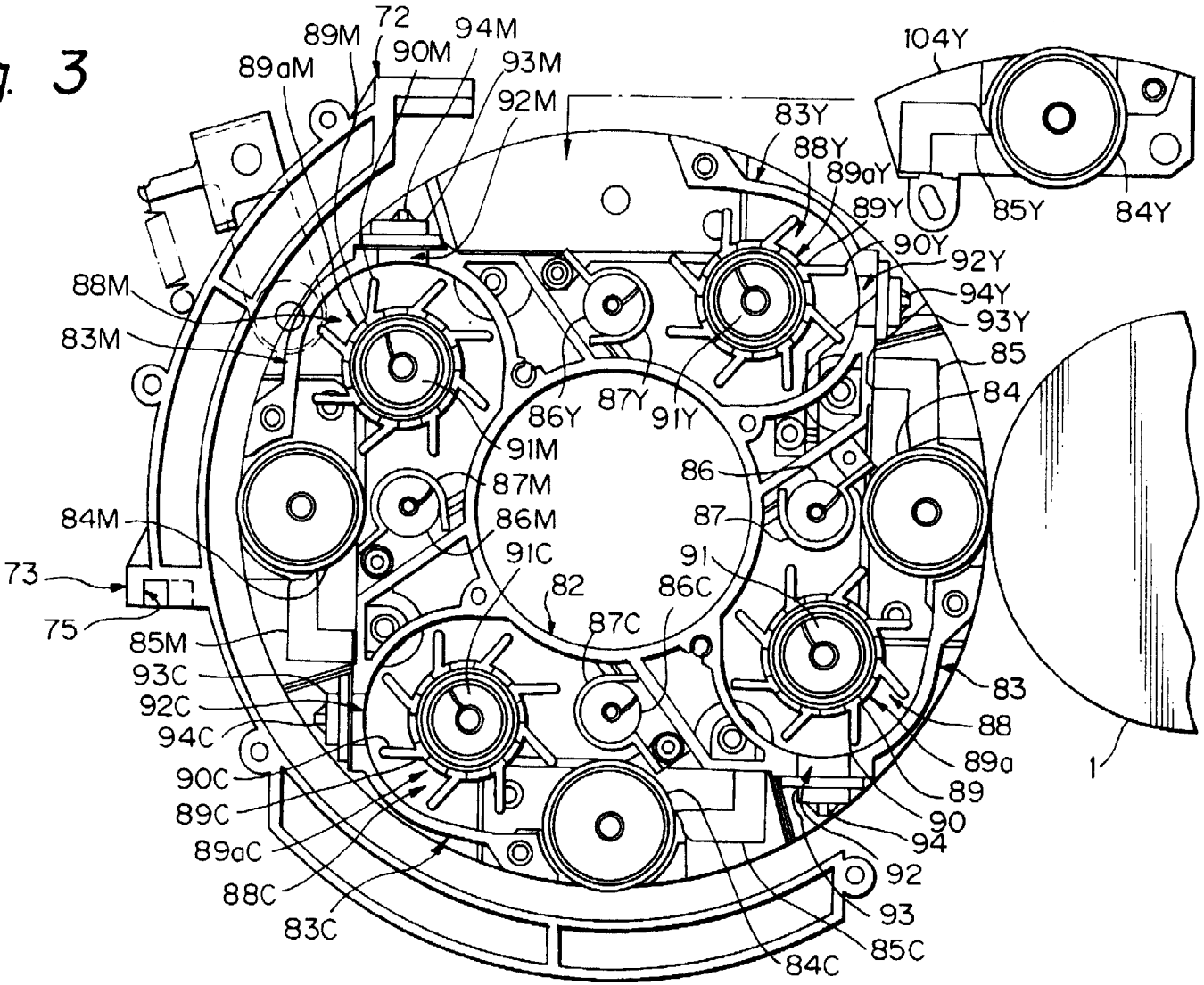
FIG. 3 is a section showing the internal arrangement of a developing unit included in the revolver.

As shown in FIG. 3, the developing unit 40 has, in addition to disk-like front and rear end walls, partition walls intervening between the front and rear walls. The partition walls consist of a hollow cylindrical portion 82 for receiving a cylindrical black toner container or bottle, and four casing portions 83, 83C, 83M and 83Y. The casing portions 83–83Y extend radially from the cylindrical portion 82 and partition the space around it into four developing chambers having substantially an identical shape. The chambers each stores a mixture of carrier and toner of particular color, i.e., a two-component type developer. In the condition shown in FIG. 3, the chamber storing the black toner and carrier is shown as facing the drum 1 at the developing position. The chambers storing the yellow toner and carrier, magenta toner and carrier, and cyan toner and carrier, respectively, are sequentially arranged in this order in the counterclockwise direction, as viewed in the figure.

Because the four developing chambers have an identical configuration, the following description will concentrate on the black developing chamber located at the developing position. The constituents of the other developing chambers are distinguished from the constituents of the black developing chamber and from each other by suffixes Y, M and C.

In the black developing chamber, the casing part 83 is formed with an opening facing the drum 1. A developing roller 84 is positioned in the chamber and partly exposed to the outside through the opening. Also disposed in the chamber are a doctor blade 85, an upper screw 86, a guide 87 for the screw 86, and a paddle 88. The doctor blade 85 regulates the amount of toner to be conveyed by the roller 84 to the developing position. The upper screw 86 conveys part of the developer removed by the doctor blade 85 from the rear to the front along the axis thereof. Specifically, the paddle 88 has a hollow cylindrical portion 89 formed with a plurality of developer outlets **89*a* extending in the axial direction of the roller 84, and a plurality of blades 90 extending radially from the portion 89. A lower screw 91 is disposed in the portion 89 and conveys the developer along the axis thereof in the opposite direction to the screw 86. The casing portion is formed with an outlet 92 below the lower screw 91. The outlet 92 extends in a chord direction of the revolver and is selectively used to discharge a deteriorated developer or to replenish a fresh developer (with toner). A cap 93 is fitted on the casing portion by, for example, a screw 94 in order to close the outlet 92**.

Figure 4:
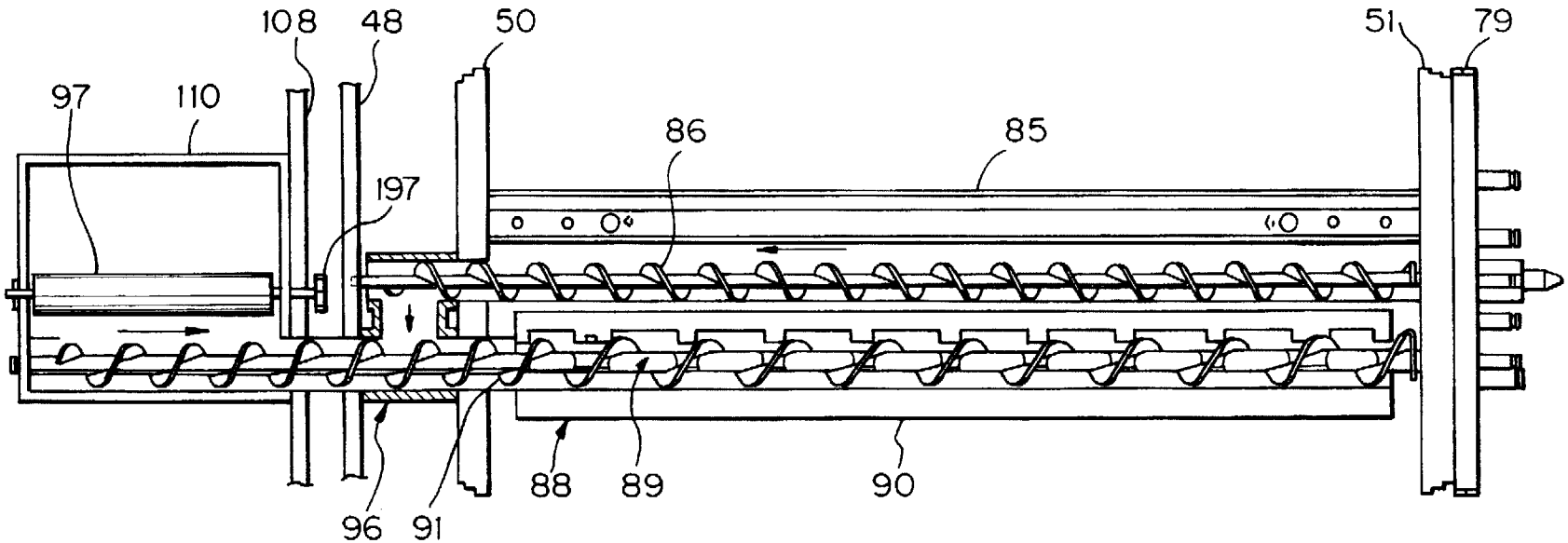
FIG. 4 is a vertical section of a black developing chamber in a plane containing the axes of upper and lower screws.

As shown in FIG. 4, the front ends of the screws 86 and 91 are extended to the outside of the effective length of the developing roller 84 (to the outside of the end wall 50 of the developing unit 40 in the illustrative embodiment). A drop section 96 is formed around the extensions of the screws 86 and 91. In the drop section 96, the developer conveyed by the screw 86 is dropped onto the screw 91 by gravity. The front end of the screw 91 is further extended beyond the drop section 96 to a communication chamber below a toner supply roller 97 which is included in the toner storing unit 45, as will be described specifically later. In this configuration, the developer deposited on the roller 84 is partly removed by the doctor blade 85 and then conveyed to the front by the guide 87 and screw 86. At the drop section 96, this part of the developer is dropped onto the screw 91. The screw 91 conveys the developer along the effective length of the roller 84. As a result, the developer is discharged from the paddle 88 into the chamber via the outlet **89*a* and again deposited on the roller 84. In this manner, the developer is agitated in the chamber in the horizontal direction. The developer discharged to the lower portion of the chamber via the outlets 89*a* is agitated by the blades 90 of the paddle 88 in the vertical direction. At the same time, the toner supply roller 97 is rotated to drop fresh toner onto the screw 91 in the communication chamber. The screw 91 conveys the fresh toner to the drop section 96. On reaching the drop section 96, the toner is mixed with the developer dropped from the screw 86. The resulting mixture enters the chamber via the outlets 89*a***, thereby increasing the toner concentration in the chamber.

A development input gear, as well as other gears, is rotatably mounted on the rear wall 51 of the developing unit 40 at the rear of the revolver input gear 79 and is capable of meshing with the development output gear 81. A gear is mounted on the end of each of the developing rollers 84 and screws 86 and 91 extending throughout the wall 51. The various rotary bodies, including the rollers 84, are driven via such a gearing.

As FIG. 3 shows by taking the yellow developing unit as an example, the front and rear walls supporting the developing roller 84Y and doctor blade 85Y are implemented as small wall pieces 104 which are separable from the other wall portions. When the chamber should be cleaned or when the parts should be replaced, the small wall pieces 104, carrying the roller 84Y and blade 85Y therewith, can be bodily removed to facilitate the access to the chamber.

Figure 2:
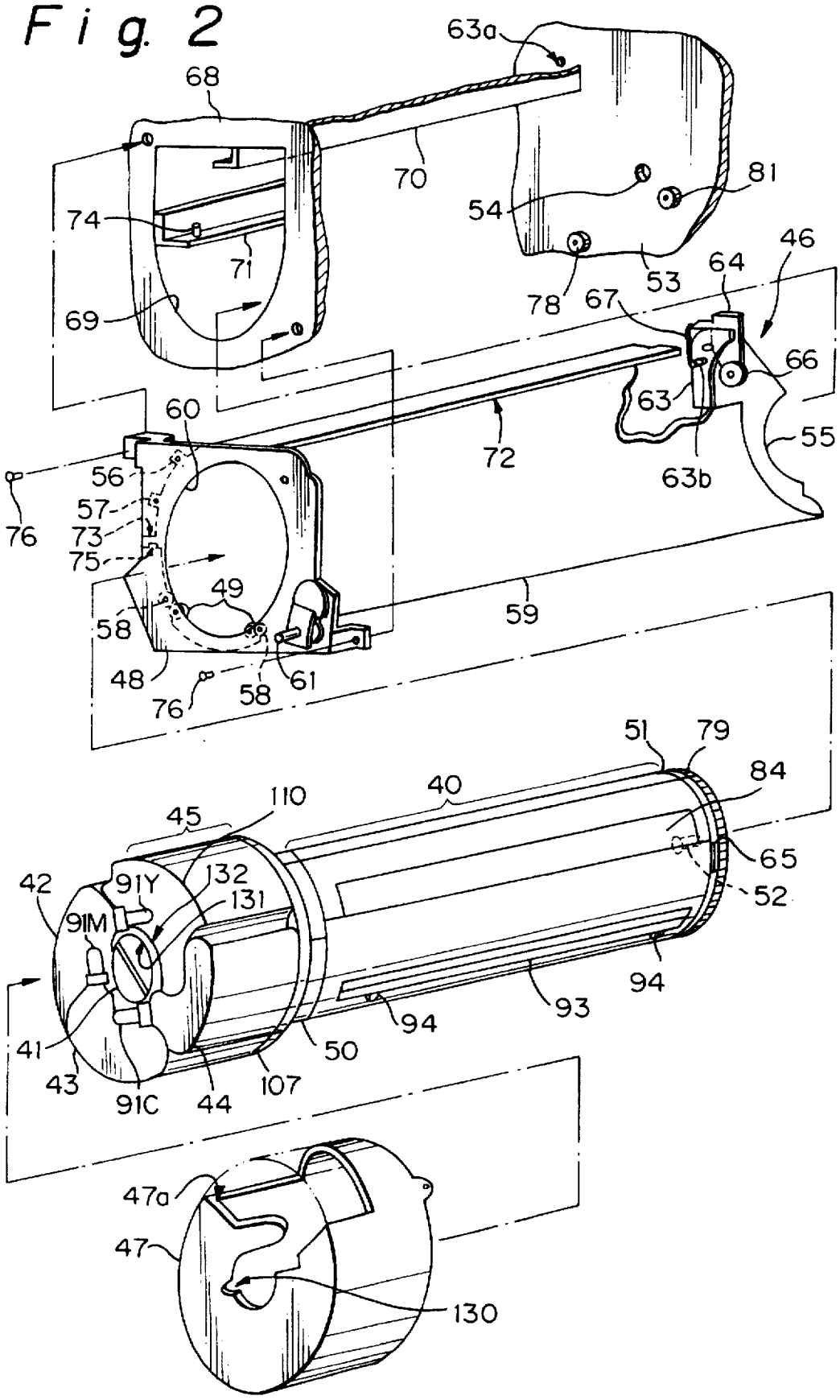
FIG. 2 is an exploded external perspective view of a rotary developing device or revolver included in the printer and embodying the present invention.
Figure 5:
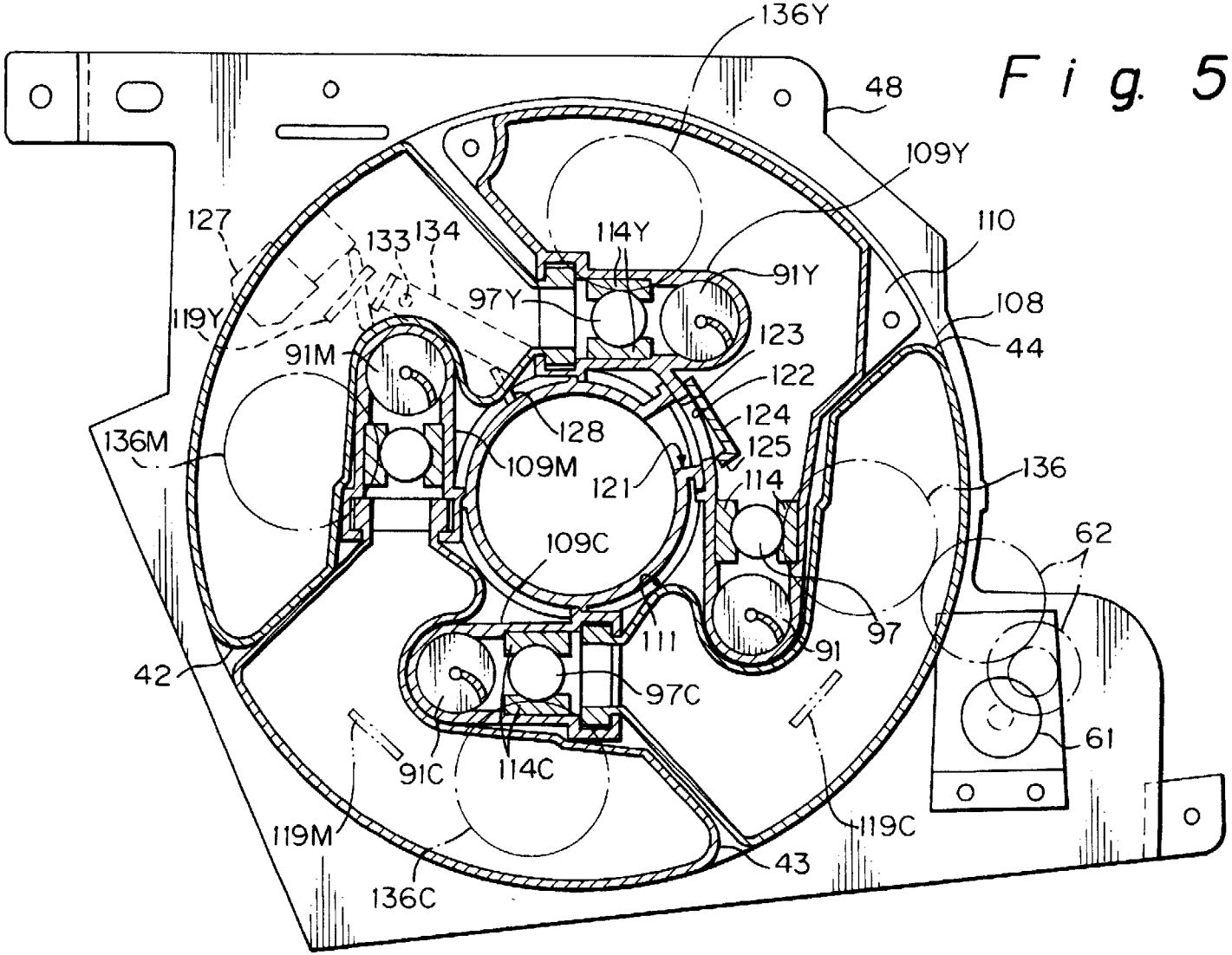
FIG. 5 is a section showing the internal arrangement of a toner storing unit also included in the revolver.

Referring to FIG. 5, the storing unit 45 has a disk-like base plate 108 (see also FIG. 2). Four receptacles, or cases, 109Y, 109M, 109C and 110 are affixed to the front end of the base plate 108, and each corresponds to one of the chambers of the developing unit 40. Toner supply rollers 97Y, 97M, 97C and 97 are disposed in the receptacles 109Y, 109M, 109C and 110, respectively. The rollers 97Y–97 are journalled to the base plate 108 and the front walls of the associated receptacles 109Y–110 such that they will be each positioned substantially just above the extension of the screw 91 when the corresponding chamber is brought to the developing position.

The base plate 108 is formed with a circular through hole 111 at the center thereof. The hole 111 allows the cylindrical black toner container (see FIGS. 16A and 6B) to be passed therethrough. The receptacles 109Y–110 are so positioned as not to interfere with the holes assigned to the lower screws 91 extending out from the developing chambers. The screws 91 each extends into one of the receptacles 109Y–110 via the base plate 108.

The rollers 97Y–97 are journalled to the base plate 108. A gear 197 is mounted on the end of each of the rollers 97Y–97extending out from the base plate 108 (see FIG. 4). As shown in FIG. 5, supply input gears 136 are rotatably mounted on the end of the base plate 108 facing the developing unit 40. The input gears 136 are respectively held in mesh with the gears 197. As shown in FIG. 5, among the input gears 136, the gear 136 of the roller 97 corresponding to the chamber located at the developing position is brought into mesh with the gear 62. The gear 62 is driven by the supply motor 61 mounted on the casing front wall 48. When the motor 61 is driven, it drives the gear 136 via the gear 62 so as to supply fresh toner.

Figure 7:
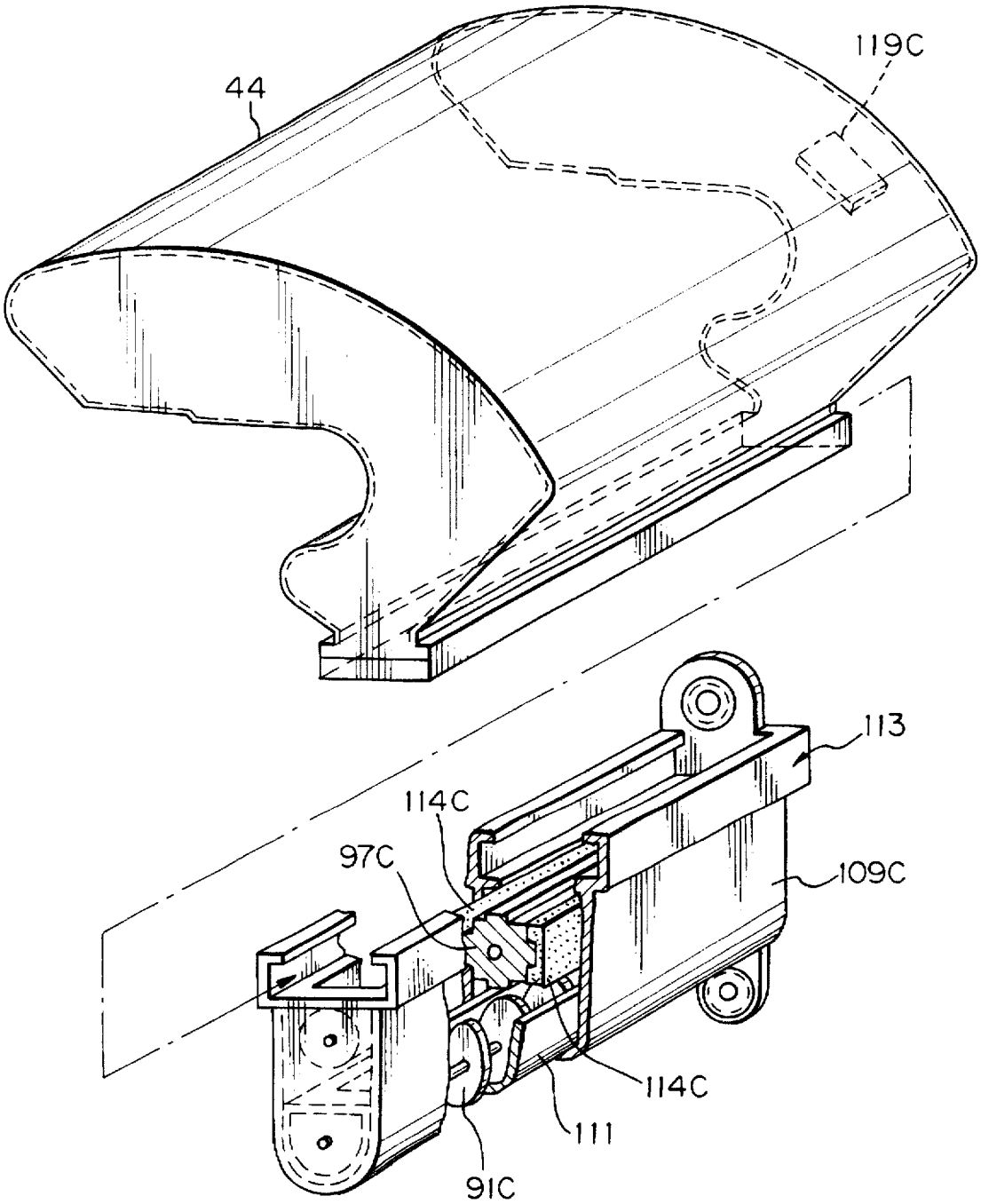
FIG. 7 is a perspective view of a color toner container and a mount portion therefor included in the revolver.

The receptacles 109Y, 109M and 109C are identical in configuration. FIG. 7 shows the receptacle 109C assigned to the cyan toner, and the cyan toner container 44. As shown, the receptacle 109C has a wall surrounding the portion of the lower screw 91 present in the receptacle 109C. The wall is formed with a toner inlet at such a position that the inlet overlies the toner supply roller 97C when the assigned chamber is located at the developing position. The inlet is surrounded by a mount portion 113. The cyan toner container 44 is mounted to the mount portion 113 with the outlet thereof facing downward, by being slid in the axial direction of the revolver. The mount portion 113 is so configured as to obviate excessive slide loads and to prevent the toner from flying about after the sliding movement of the container 44, as will be described later specifically. Seal members 114C are fitted on part of the inner periphery of the receptacle 109C which face the roller 97C. The seal members 114C and roller 97C divide the. interior of the mouth portion 113 into two portions respectively adjoining the toner container 44 and the chamber. In addition, the seal members 114C and the wall, surrounding the roller 97C and screw 91C, define the previously mentioned communication chamber which is communicated to the associated developing chamber via the hole of the base plate and drop section. As shown in FIG. 7, the rollers 97Y–97 each includes a roller portion formed with a plurality of axial grooves on the periphery thereof.

The color toner containers 42, 43 and 44 are each configured to engage with the wall, surrounding the lower screw 91, of one of the receptacles located upstream of the corresponding receptacles with respect to the direction of rotation of the revolver. Lugs 119Y, 119M and 119C are respectively formed on the outer surface of the base plate. Set sensor 118Y, 118M and 118C, shown in FIG. 8A by way of example, sense the lugs 119Y–119C, respectively. Specifically, set sensors 118Y, 118M and 118C are mounted on the rear of the base plate and implemented by reflection type or transmission type optical sensors. The sensors 118Y–118C are respectively responsive to the ends of the lugs 119Y–119C extending throughout and to the rear of the base plate. The portion of each container around the toner outlet is so configured as to obviate excessive slide loads and to prevent the toner from flying about after the sliding movement, as will be described later specifically.

Figure 10A:
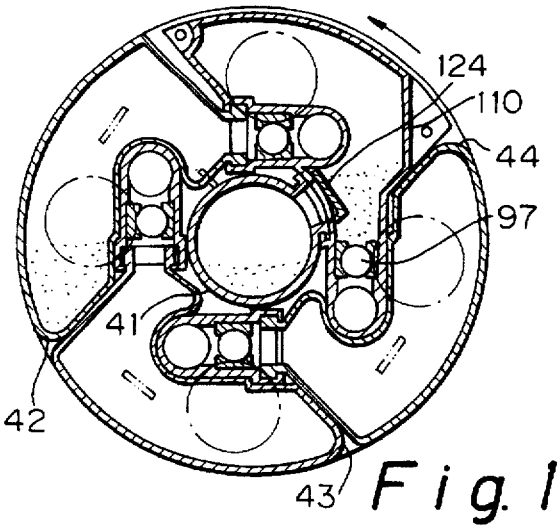
FIGS. 10A–10E demonstrate the movement of toner to occur during the rotation of the revolver.
Figure 10B:
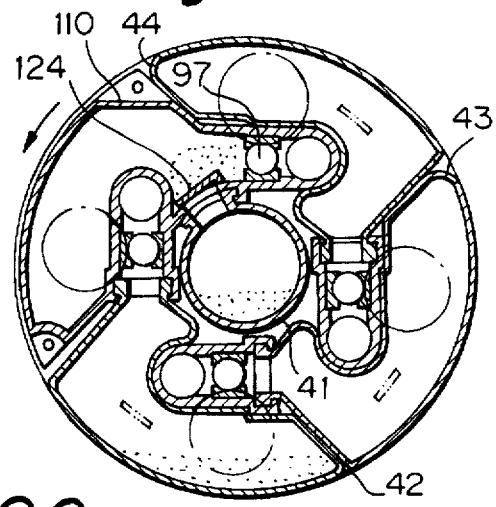

The receptacle 110 assigned to the black chamber is different from the other receptacles 109Y–109C in that it has a large space for storing black toner. Specifically, as shown in FIG. 5, the receptacle 110 has a wall substantially identical with the contour of the color toner receptacle 109Y, 109M or 109C and color toner container 42, 43 or 44 mounted thereto. Seal members 114 are fitted on the inner periphery of the portion of the receptacle 110 corresponding to the receptacle. Also, the seal members 114 define a communication chamber communicated to the associated developing chamber in cooperation with the wall surrounding the screw 91. The wall portion similar to the color toner container is formed with a toner inlet 122 in a portion thereof which faces the center line of the revolver, thereby defining a space for storing the toner received from the inlet 122. Such a configuration of the wall portion is to make full use of the space available at the front of the base plate 108. In addition, this wall portion guarantees a space for the toner accumulated in the vicinity of the toner inlet, as shown in FIGS. 10A and 10B, to be released therefrom, as indicated by an arrow A in FIG. 10C. A shutter 124 is rotatably supported at one end by a shaft 123 parallel to the axis of the revolver. The inlet 122 can be closed by the shutter 124 at the inside of the receptacle 110. A seal member 125 is fitted on the edge of the shutter 124.

Regarding the black toner receptacle 110, assume that about 100 printings of size A4 and having an image ratio of 70 percent should be continuously produced. Then, the receptacle 110 will be provided with a capacity capable of storing 50 grams of toner.

Figure 6A:
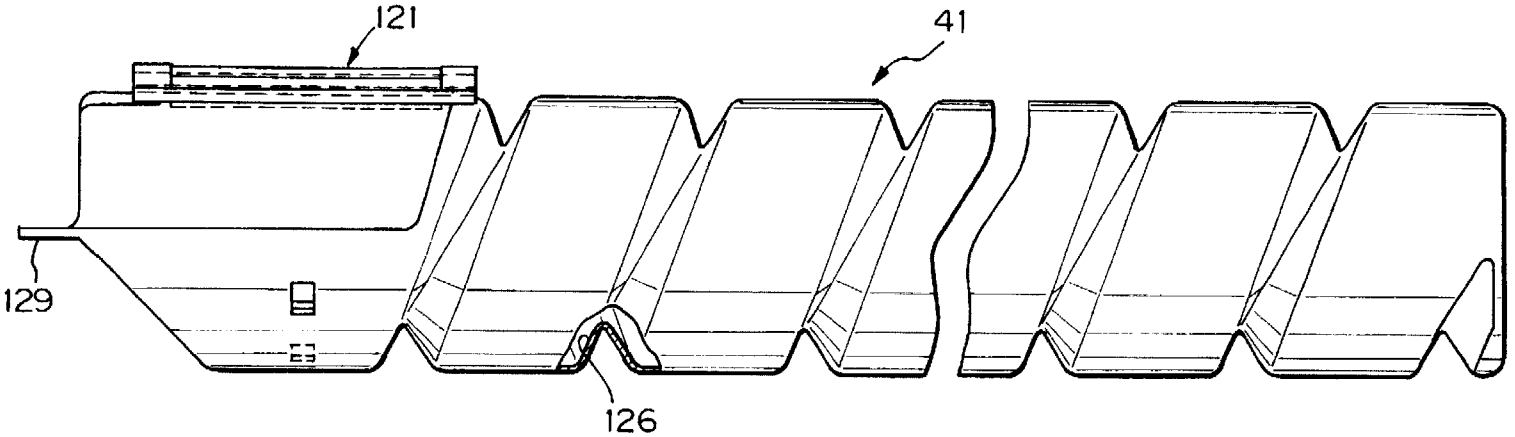
FIG. 6A is a side elevation of a black toner container.
Figure 6B:
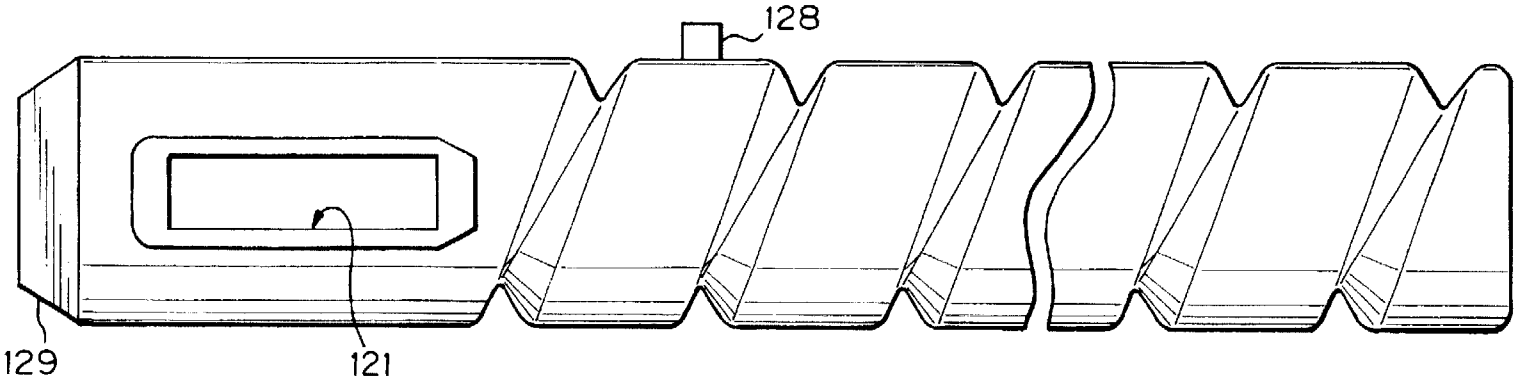
FIG. 6B is a front view of the black toner container.

As shown in FIGS. 6A and 6B, the black toner container 41 has the outlet 121 formed in the circumferential wall of one end portion thereof. A spiral ridge 126 is formed in the inner periphery of the container 41 from the end remote from the outlet 121 toward the outlet 121. When the container 41 is mounted to the revolver, the ridge 126 rotates integrally with the revolver so as to feed the toner from the rear end toward the outlet 121. A lug 128 is provided on the outer periphery of the container 41 at the rear of the outlet 121. A grip portion 129 is provided on the front end of the container 41.

Specifically, the cover 47, FIG. 2, is formed with a notch 130 and a notch **47*a* for the insertion of the container 41. The container 41 is positioned such that the outlet 121 faces upward. After the seal member closing the outlet 121 has been removed, the container 41 is inserted into the revolver through the notch 47*a* with the lug 128 thereof aligned with the notch 130. The container 41 is inserted to the deepest position where the rear end is received in the hollow cylindrical portion 82 of the developing unit 40, and where the front end is substantially flush with the front of the front walls of the cases of the toner storing unit 40, as indicated by a phantom line in FIG. 3. Then, the container 41 is rotated clockwise, as viewed in the figures, about its own axis with the grip portion 129 held by hand, until the outlet 121 aligns with the inlet 122. Let this rotation be referred to as a set rotation. During the set rotation, the lug 128 is sensed by a set sensor 127 via a link 134 (rotatable about a shaft 133) mounted on the rear of the casing front wall 48**.

Figure 8A:
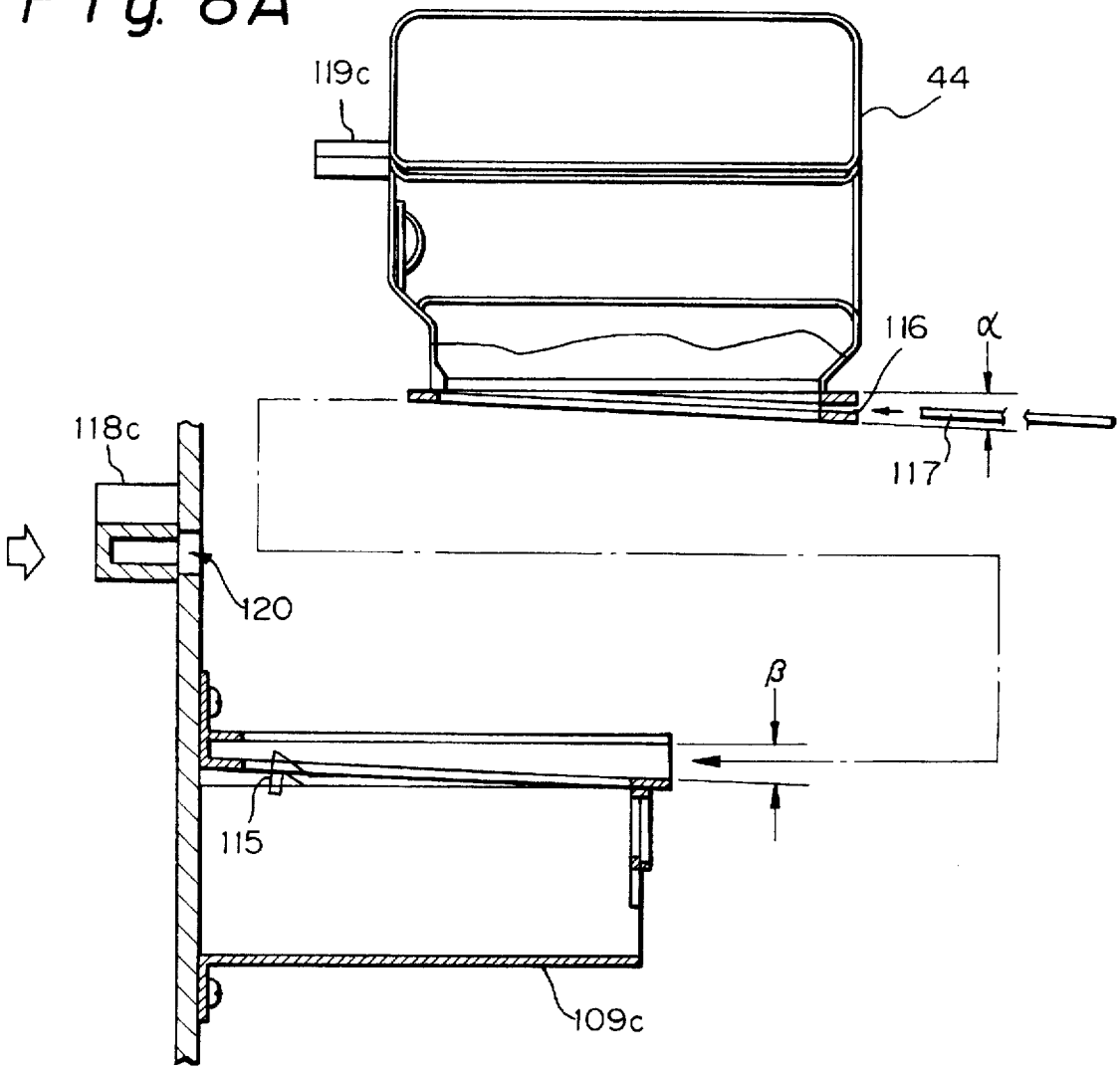
FIG. 8A demonstrates how the container is mounted to the mount portion.

As FIGS. 7 and 8A show by taking the cyan toner receptacle as an example, the mount portion 113 of each color receptacle allows the associated toner container to be mounted and dismounted by being slid in the axial direction of the revolver. A safety member 115 (see FIG. 8A) is provided on the mount portion 113 and protrudes into the container via the toner outlet. The safety member 115 prevents the container from being pulled out when it is simply slid in the opposite direction, i.e., toward the operator. A slit 116 is formed in the outlet portion of the container. To remove the toner container from the mount portion 113, a shutter member 117 is inserted into the slit 116 to push the safety member 115 out of the container. When a new color toner container whose toner outlet is closed by a seal member is to be mounted to the mount portion 113, it is slid on the portion 113, and then the seal member is removed to uncover the toner outlet.

In the illustrative embodiment, the toner outlet portions of the color toner containers 42–44 and the mount portions 113Y–113C of the receptacles 109Y–109C are each provided with a unique configuration, as follows. As shown in FIG. 8A, the container 44, for example, has its toner outlet portion tapered by an angle $\alpha$ in the sliding direction. Likewise, the mount portion of the receptacle 109C has its mount portion tapered by an angle $\beta$ in the sliding direction. These angles $\alpha$ and $\beta$ allow the container 44 to slide without encountering an excessive load and, in addition, ensure the close contact of the toner outlet portion and toner inlet portion.

Figure 8B:
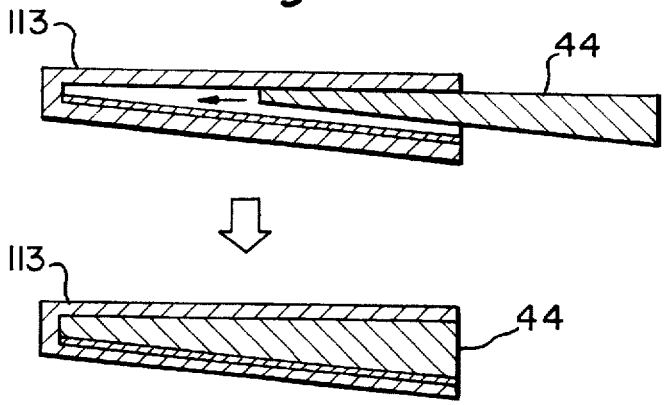
FIG. 8B shows how the container is slid into the mount portion.

Specifically, FIG. 8B shows, in upper part thereof, the initial stage of insertion of the toner outlet portion of the color toner container 44 into the mount portion 113C. As shown, the end portion having a comparatively small width in the up-and-down direction enters the front part of the mount portion 113C having a comparatively great width in the same direction. That is, the insertion begins with the toner outlet portion lightly contacting the mount portion 113C. Immediately before the insertion ends, the end portion begins to closely contact the mount portion 113C; the contact pressure increases sufficiently in a short period of time. At the end of the insertion, a high contact pressure acts between the end outlet portion and the mount portion 113C, as shown in lower part of FIG. 8B. To further enhance the close contact, a seal member may be adhered to the edge portion of the toner inlet of the mount portion 113C. The angles α and β should preferably be the same as each other.

As stated above, in the embodiment, the toner outlet portion sequentially slides in light contact with the toner inlet portion up to the time when the insertion is about to end and there is contact over a wide area. This reduces the load to act on the outlet portion and the wear of the seal member. In addition, at the end of the insertion, a contact pressure high enough to prevent the toner from flying about is set up.

Figure 9:
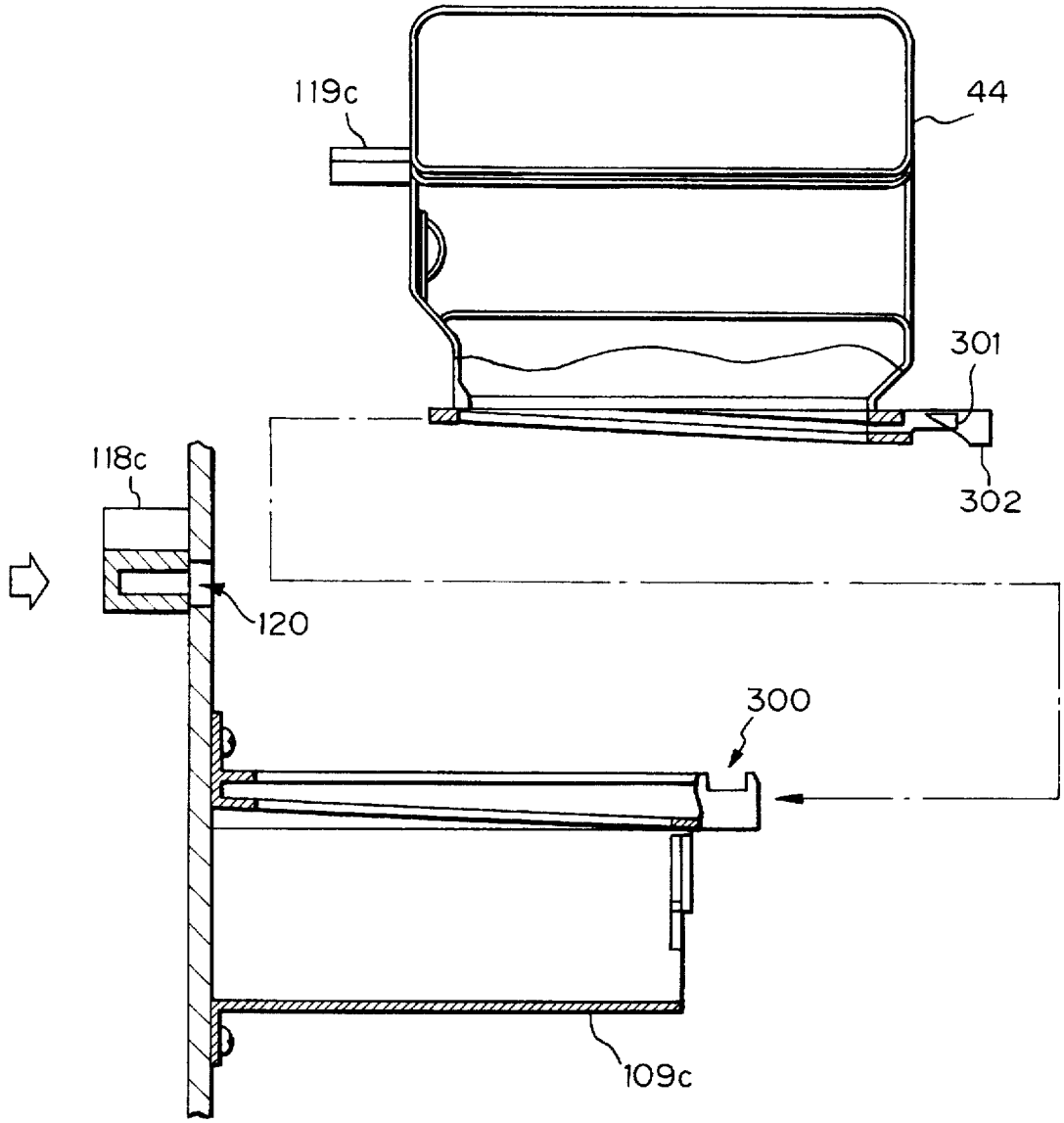
FIG. 9 shows a modification of the color toner container and mount portion.

As shown in FIG. 8A, to remove the container 44, the safety member 115 is pressed downward away out of the container 44. FIG. 9 shows an alternative arrangement for locking and unlocking the container 44. As shown, the receptacle 109C is formed with a hole 300 while the receptacle 44 is provided with a grip 302 formed with a pawl 301. In this configuration, when the container 44 is inserted up to a preselected position in a direction indicated by an arrow, the pawl 301 mates with the hole 300. As a result, the receptacle 44 cannot be dismounted when simply slid in the other direction, i.e., toward the operator. When the the pawl 301 is released from the hole 300 via the grip 302, the receptacle 44 can be pulled out away from the receptacle 109C.

FIGS. 10A–10E demonstrate how the toner in each of the toner containers 41–44 and black toner receptacle 110 moves when the revolver rotates in a direction indicated by an arrow. Because the color toner containers 42–44 are identical in respect of the movement of the toner, only the toner in the yellow toner container 42 is shown. As for the black toner, when the black chamber is located at the developing position, the toner in the receptacle 10 moves downward due to its own weight while being guided by the wall of the receptacle 110, as shown in FIG. 10A. The black toner accumulates in the lower portion of the receptacle 110 above the toner supply roller 97 and corresponding to a conventional hopper. Hence, the black toner is ready to be fed to the communication chamber where the lower screw 91 is present. At this instant, the outlet 121 of the black toner container 41 faces upward, preventing the black toner from being fed into the receptacle 110. Also, the shutter 124 prevents the black toner from flowing reversely from the receptacle 110 into the container 41.

Figure 10C:
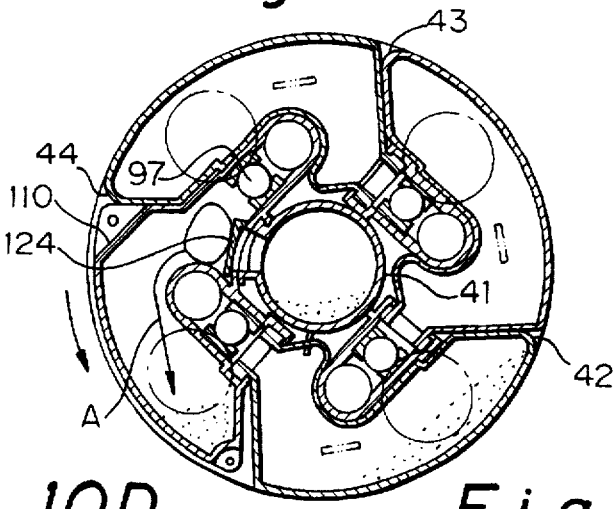
Figure 10D:
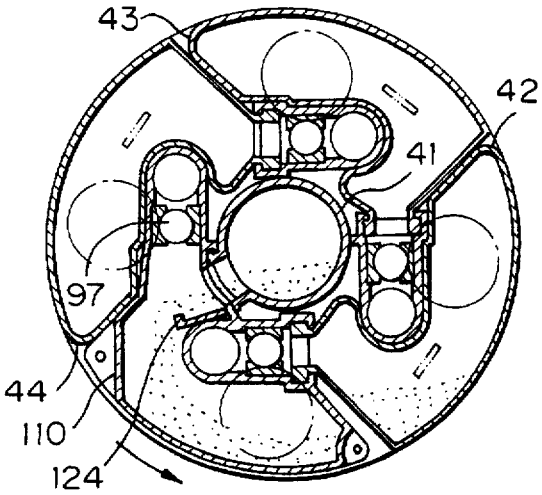
Figure 10E:
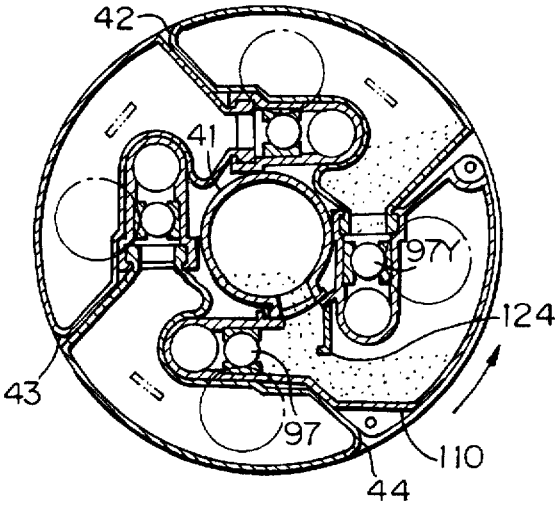

As shown in FIG. 10B, when the revolver rotates 90 degrees in a direction indicated by an arrow, the black toner sequentially moves from the position adjoining the roller 97 toward the inlet 122 located below and at the left of such a position. As shown in FIG. 10C, when the revolver further rotates 45 degrees as indicated by an arrow, the toner accumulated in the vicinity of the toner inlet bodily flows downward. This allows fresh toner to be received from the toner container. As shown in FIG. 10D, when the revolver rotates another 45 degrees as indicated by an arrow, the shutter 124 opens by rotating about the shaft due to its own weight. At the same time, the black toner adjoining the outlet 121 starts moving into the receptacle 110 due to gravity. As shown in FIG. 10E, when the revolver further rotates 90 degrees, the black toner is further transferred to the receptacle 110, i.e., most of the toner around the outlet 121 is transferred to the receptacle 110. Thereafter, before the revolver further rotates 90 degrees to the position shown in FIG. 10A, the shutter 124 closes to cover the toner inlet 122.

As stated above, in the embodiment, the black toner receptacle, or hopper portion, 101 is provided with a unique wall configuration. As shown in FIGS. 10A and 10B by way of example, the toner accumulates in the vicinity of the toner inlet. When the receptacle 101 is moved from the replenishing position shown in FIG. 10D toward the position shown in FIG. 10E, the toner moves to another position in the receptacle 101 due to gravity when the receptacle is brought to the position shown in FIG. 10C. Hence, the toner can be desirably replenished from the toner container into the receptacle 101 while the revolver is in rotation.

In the position of FIG. 10A to the position of FIG. 10B, the toner is apt to flow reversely from the receptacle 101 into the toner container. In this angular range, the shutter 124 of the receptacle 101 closes the toner inlet. In addition, in the angular range corresponding to the replenishing position (from the position of FIG. 10D to that of FIG. 10E), the shutter 124 moves due to gravity and uncovers the toner inlet. Consequently, the toner can be efficiently replenished from the toner container into the receptacle 101 while being prevented from returning to the container.

Figure 11A:
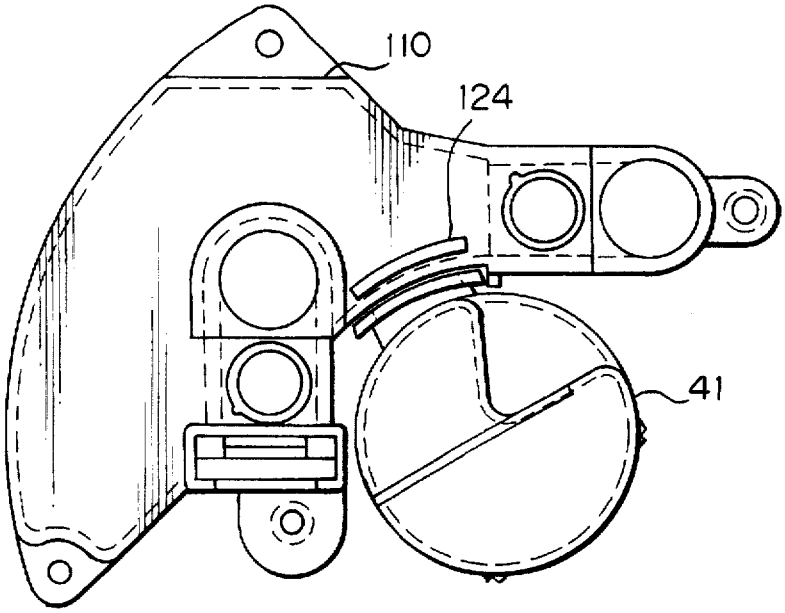
FIGS. 11A and 11B show a modified form of a shutter.
Figure 11B:
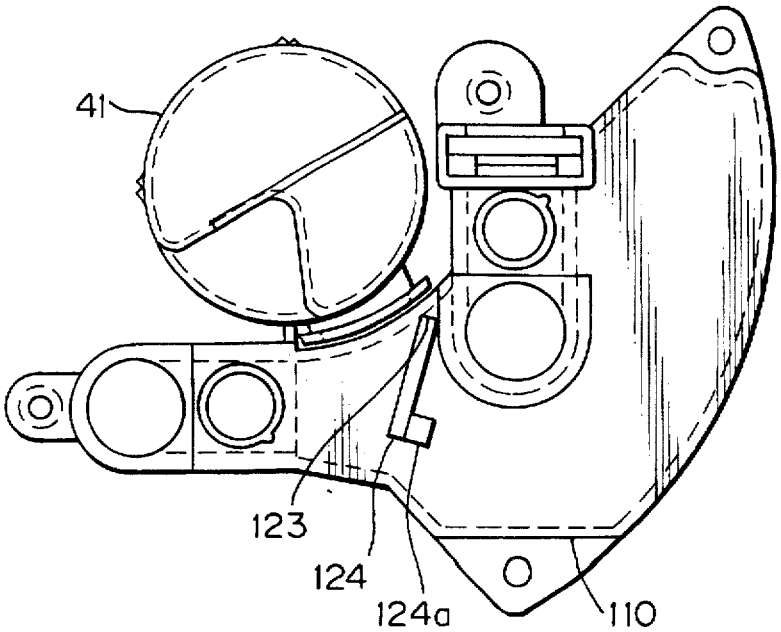

FIGS. 11A and 11B each shows a specific configuration of the shutter 124. As shown in FIG. 11A, the shutter 124 should preferably extend along the edge portion of the toner inlet of the receptacle within the receptacle. This allows the shutter 124 to contact the edge portion without any clearance and thereby enhances hermetic sealing. In FIG. 11B, the shutter 124 is provided with a weight **124*a*** at the free end thereof in order to ensure the opening and closing movement.

As shown in FIG. 10A, when the black developing chamber is located at the developing position, the receptacle 110 assigned to the black toner container 41 is not located at the replenishing position. If this chamber is continuously used to produce a great number of black-and-white printings, the entire toner in the receptacle 110 will be consumed. This will lower the image density despite that the toner is still left in the container 41. To eliminate this occurrence, it is necessary to interrupt the printing operation and then rotate the revolver to replenish the toner into the receptacle 110. In a usual full-color print mode, the revolver is sequentially rotated for color switching, as shown in FIGS. 10A–10E, while being sequentially stopped at the four different positions shown in FIGS. 10A, 10B, 10D and 10E. Therefore, the receptacle 110 passes through the replenishing position only once for one rotation of the revolver. In this condition, it is likely that the toner brought to the vicinity of the outlet of the container 41 by the spiral ridge 126 cannot be fully dropped via the outlet. In light of this, when the revolver is rotated after the interruption of the printing operation or when it is rotated at a preselected period in order to avoid the interruption, the rotation of the revolver may be switched such that the revolver moves back and forth at least once in a preselected angular range including the replenishing position. This successfully replenishes the toner from the container 41 to the receptacle 110 more efficiently. For this purpose, the previously mentioned revolver motor, for example, is driven in opposite directions. In each of the conditions shown in FIGS. 10D and 10E, the revolver is positioned with the roller 66 mating with one of the recesses 65. It is, therefore, preferable that the above reciprocating motion be effected in the angular range between the positions shown in FIGS. 10D and 10E. Of course, to remove this limitation on the angular range, the bracket 64 may be adequately actuated by a solenoid or similar actuator to forcibly prevent the roller 66 from mating with the recess 65.

Figure 12A:
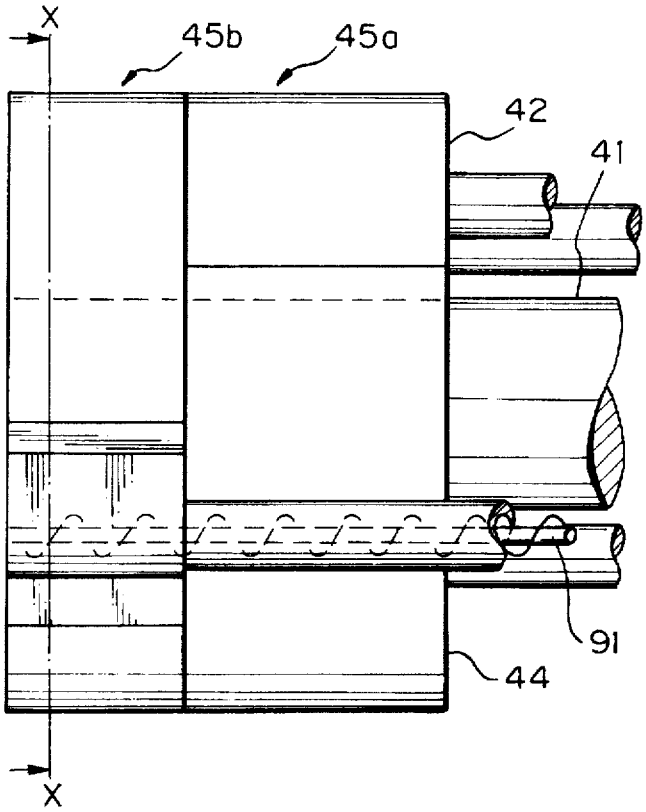
FIG. 12A is a side elevation of a modification of the toner storing unit.
Figure 12B:
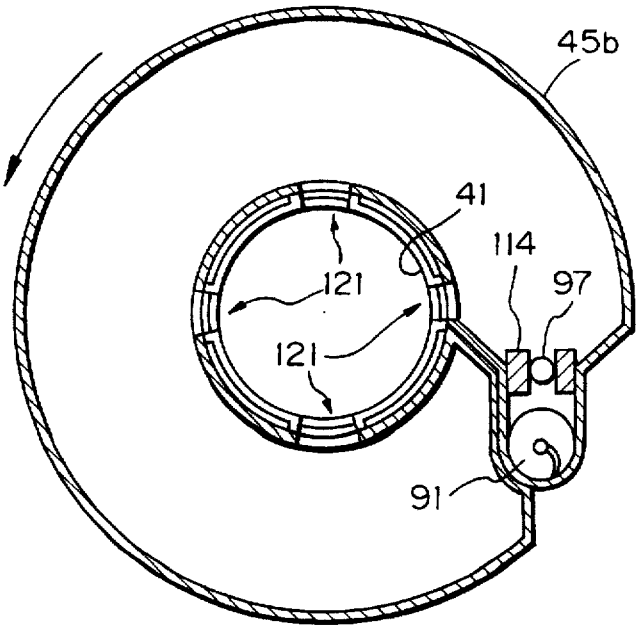
FIG. 12B is a section along line X—X of FIG. 12A.

To allow the black developing chamber to be continuously used with a minimum of interruption of the printing operation, the transfer of the toner from the container 41 to the receptacle 110 should be effected more efficiently by the usual rotation of the revolver. FIGS. 12A and 12B show a specific configuration of the toner storing unit for achieving the above purpose. FIG. 12A is a side elevation of the unit, as seen from the right. FIG. 12B is a section along line X—X of FIG. 12A. As shown, the unit has a color toner receptacle portion 45*a* in which three color toner receptacles, each carrying a respective container, are mounted on the unit base plate, and a black toner receptacle portion 45*b* located at the front of the portion 45*a* and surrounding the black toner container 41. The container 41 is formed with four toner outlets 121 in its circumferential wall at intervals of 90 degrees in matching relation to the four stop positions of the revolver. Likewise, the inner circumferential wall of the receptacle portion 45*b* is formed with four toner inlets at intervals of 90 degrees and respectively facing the outlets 121. With this configuration, the unit can replenish the black toner from the container 41 into the receptacle 45*b* at any one of the stop positions of the revolver. While the revolver is rotated in a direction indicated by an arrow in FIG. 12B in order to bring the black chamber to the developing position, the toner from the container 41 is moved on and relative to the outer circumferential wall of the receptacle 45*b*. As a result, the toner is collected on the roller 97 disposed in the receptacle 45*b*.

Figure 13A:
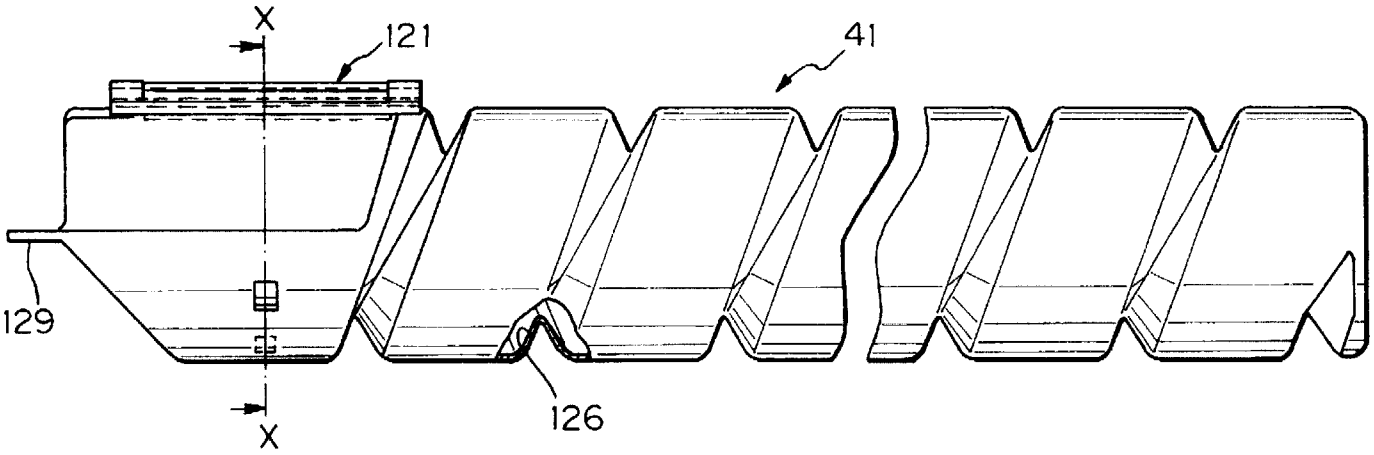
FIG. 13A is a front view of a modified form of the black toner container.
Figure 13B:
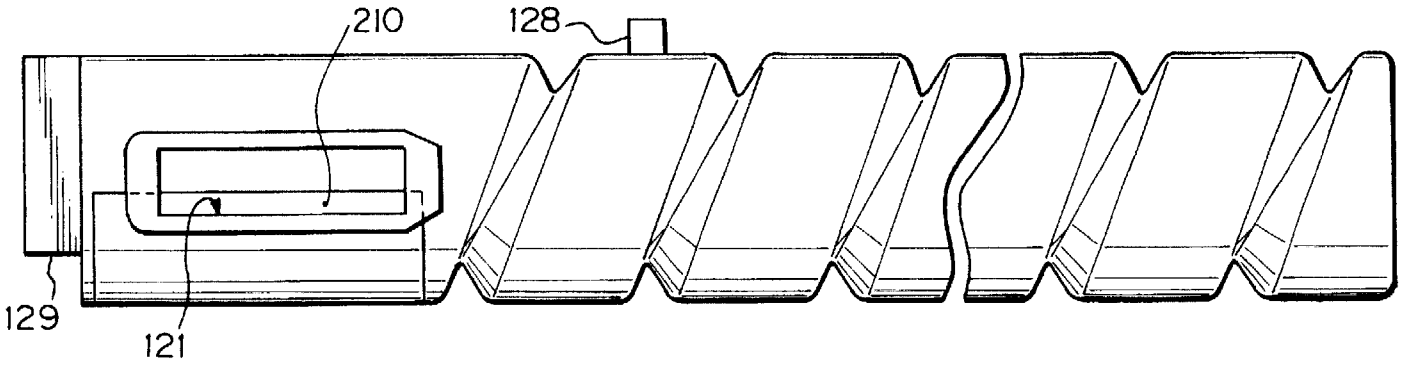
FIG. 13B is a plan view of the container.
Figure 13C:
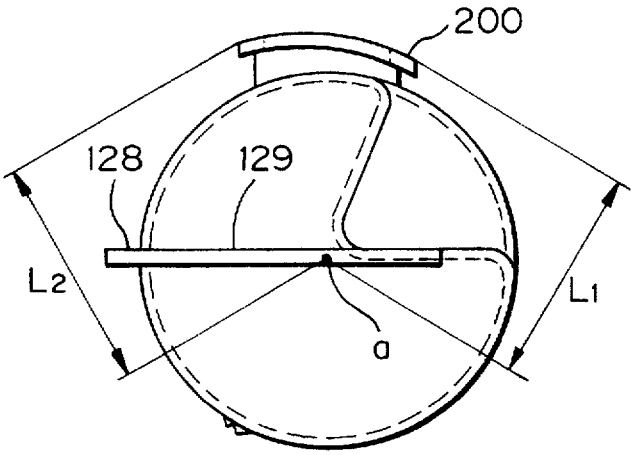
FIG. 13C is a side elevation of the container, as viewed from the left.

FIGS. 13A–13C show a specific implementation for guaranteeing, when the container 41 has been mounted to the revolver, the close contact of the edge portion of the toner outlet 121 and that of the toner inlet 122 without increasing the load on the set rotation. As shown, the edge portion of the outlet 121 is protruded from the periphery of the container 41 to form a collar portion 200. Assume that the set rotation of the revolver occurs about a center line C (see FIG. 14B), and that the container 41 has a center line a coincident with the center line C. Then, the distance between the center line a and the end surface of the collar portion 200 is smaller at the downstream side ($L_1$) than at the upstream side ($L_2$) with respect to the direction of the set rotation. That is, the collar portion 200 is tapered with respect to the sides of cylinders having the center line a (in the embodiment, the side of the container 41 itself is one of the sides of such cylinders).

Figure 14B:
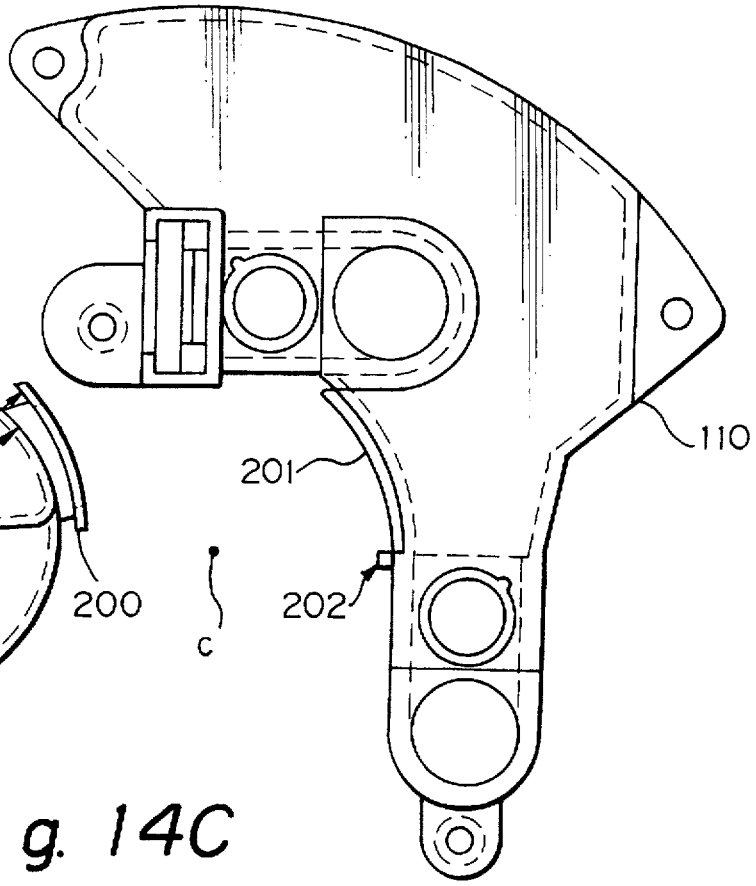
FIG. 14B shows a receptacle assigned to the black toner container.
Figure 14A:
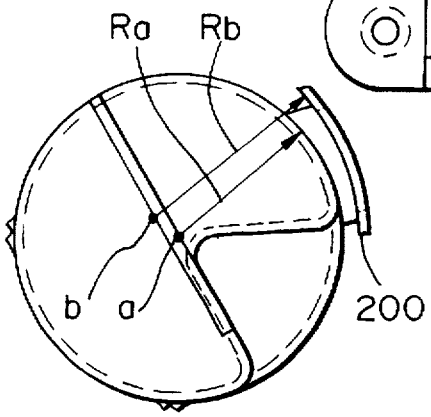
FIG. 14A shows a collar portion included in the black toner container.

For example, as shown in FIG. 14A, assume a cylinder having a center line b deviated from the center line a of the container 41, i.e., a cylinder having a radius Rb. Then, the end surface of the collar portion 200 is implemented by part of the side of the cylinder which satisfies the above relation $L_2>L_1$.

As a result, the end surface is tapered with respect to the side of the cylinder having the center line a, e.g., the circumferential wall of the container 41.

The edge portion of the toner inlet 122 of the receptacle 110 (see also FIG. 14C) and the edge portion of the seal member 201 adhered thereto (not shown in FIG. 14C) are so configured as to extend along the end surface of the collar portion 200. For example, in the case of the receptacle 110 shown in FIG. 14A, they are configured to closely fit the side of the cylinder having the radius Rb, as shown in FIG. 14B.

The movement of the collar portion 200 will be described hereinafter. Assume that the center line a of the container 41 shown in FIG. 14A is located at the center line C for set rotation and facing the toner inlet 122 of the receptacle 110 shown in FIG. 14B, that the set rotation is effected clockwise, that the collar portion 200 exists at a position indicated by a solid line in FIG. 14C at a certain moment during the set rotation, that the center line b corresponding to the end surface of the portion 200 is located at $b_1$, and that the portion 200 is brought to a position indicated by a phantom line in FIG. 14C at the moment when the set rotation ends. Then, the center line b is brought to $b_2$ at the moment when the set rotation ends. By comparing the two instantaneous positions, it will be seen that the end surface of the collar portion 200 sequentially approaches the edge portion of the inlet 122 during the set rotation. Hence, if the edge portion of the inlet 122, e.g., the surface of the seal member 201 is configured to extend along the end surface of the portion 200, the end surface of the portion 200 progressively approaches, but does not contact, the edge portion of the inlet 122 at the initial stage. Immediately before the end of the set rotation, the end surface begins to contact the edge portion. Thereafter, the contact pressure between the end surface and the edge portion is increased to a sufficient degree within a short period of time up to the end of the set rotation. In addition, because the portion 200 approaches the edge portion of the inlet 122 without contacting it up to the time immediately before the set rotation ends, the set rotation is free from a heavy load while the seal member 201 wears little.

Figure 14C:
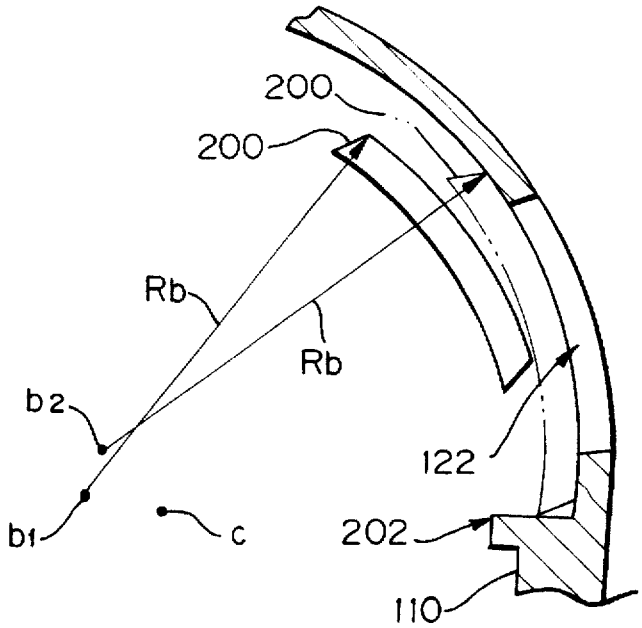
FIG. 14C shows the movement of the collar portion when the black toner container is mounted to the receptacle.

In the specific configuration shown in FIGS. 14B and 14C, a lug 202 is formed at the end of the toner inlet 122 of the receptacle 110. The set rotation ends when the leading edge of the collar portion 200 abuts against the lug 202. The set rotation is effected with the center line a of the container 41 coinciding with the center line C for set rotation and facing the inlet 122. For this purpose, as shown in FIG. 5, part of each color toner receptacle guides the side of the container 41.

Figure 13D:
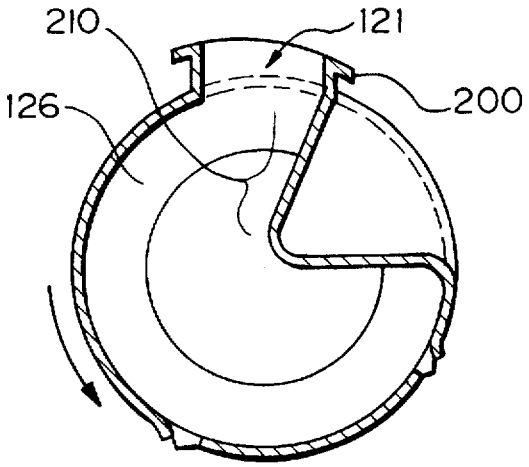
FIG. 13D is a section along line X—X of FIG. 13A.

As shown in FIG. 13D, the container 41 of the embodiment further includes an internal jutted portion or jut 210. Specifically, part of the inner periphery contiguous with the upstream edge of the outlet 121 in the direction of set rotation, indicated by an arrow, is jutted toward the center to form the jut 210. The jut 210 increases the toner discharging efficiency by surely discharging from the outlet 121 the toner conveyed by the spiral ridge 126 to the vicinity of the outlet 121. A reference will be made to FIGS. 15A–15E for describing the function of the jut 210 together with the general movement of the toner in the toner storing unit 45.

Figure 15A:
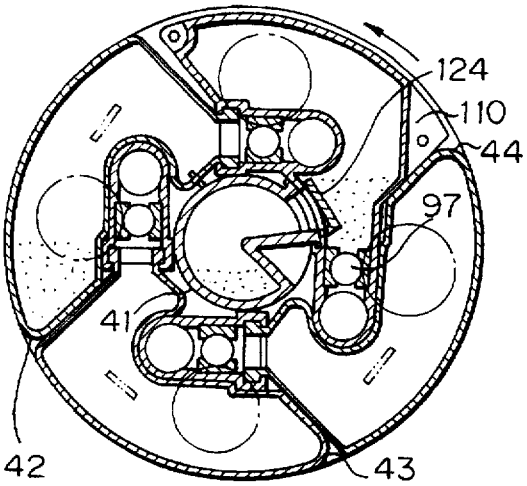
FIGS. 15A–15D demonstrate the movement of toner in the toner containers to occur during the course of rotation of the revolver.

FIGS. 15A–15D demonstrate the movement of toners in the toner containers 41–44 and black toner receptacle 110 to occur when the revolver is rotated in a direction indicated by an arrow. Because the color toners in the containers 42–44 move in exactly the same manner, let the following description concentrate on the yellow toner container 42 by way of example. As shown in FIG. 15A, when the black chamber is located at the developing position, the black toner in the receptacle 110 moves downward due to gravity while being guided by the inner surface of the receptacle 110. The black toner, therefore, accumulates in the lower portion of the range above the replenishing roller 97 and corresponding to a hopper. In this condition, the black toner is ready to be replenished into the communication chamber where the lower screw 91 exists. At this instant, the outlet 121 of the container 41 faces upward rightward, so that no fresh toner is replenished into the receptacle 110. At the same time, the shutter 124 prevents the toner from being returned from the receptacle 110 to the container 41.

Figure 15B:
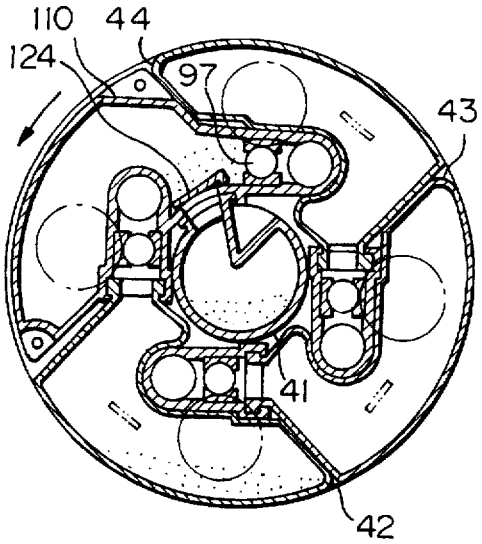
Figure 15C:
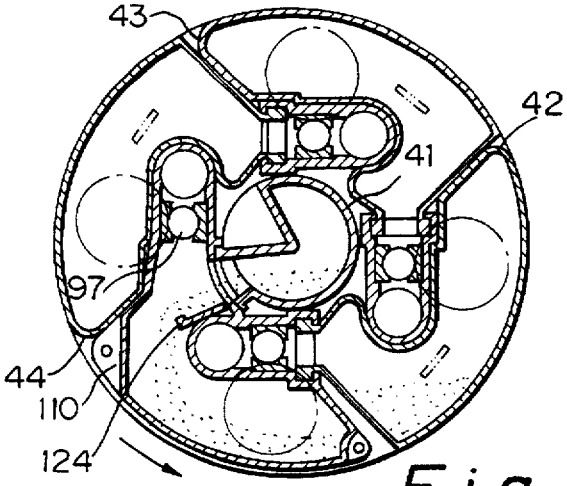
Figure 15D:
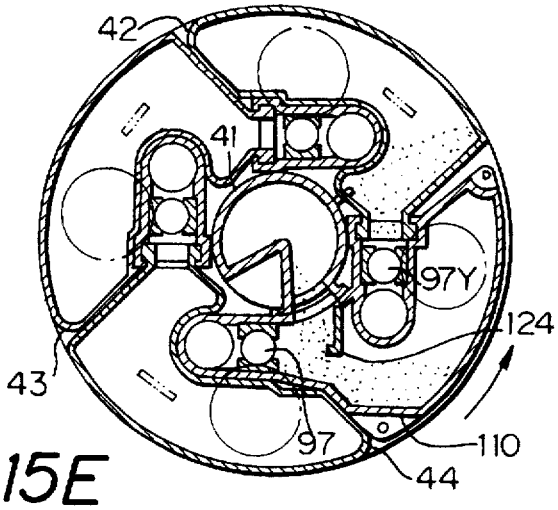
Figure 15E:
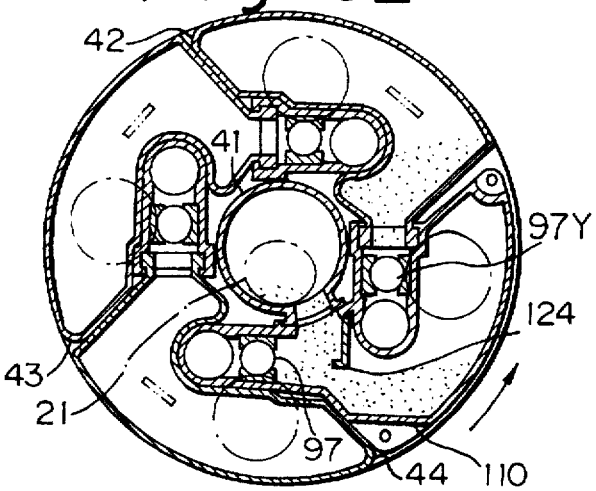
FIG. 15E shows a comparative arrangement.

As shown in FIG. 15B, when the revolver is rotated 90 degrees in a direction indicated by an arrow, the black toner sequentially moves from the vicinity of the roller 97 toward the toner inlet 122. As shown in FIG. 15C, when the revolver is further rotated 90 degrees, the shutter 124 rotates due to its own weight to uncover the inlet 122. As a result, the toner in the vicinity of the outlet 121 begins to flow into the receptacle 110 due to gravity. As shown in FIG. 15D, when the revolver is further rotated 90 degrees, most of the toner in the vicinity of the outlet 121 is replenished into the receptacle 110.

Mainly during the rotation from the position of FIG. 15C to that of FIG. 15D, the jut 210 exhibits its function. FIG. 15C demonstrates for comparison the same condition as FIG. 15D except that the container 41 lacks the jut 210. As shown, when the jut 210 is absent, the toner does not fall in the outlet 121, but rushes to the downstream side over the outlet 121, during the transition from the position of FIG. 15C to that of FIG. 15D. This part of the toner stays in the container 41 until the revolver rotates to a position where the outlet 121 again faces downward, resulting in efficient toner discharge. As shown in FIG. 15D, the jut 210 receives the toner moved past the outlet 121 and causes it to flow into the outlet 121. This successfully increases the toner discharging efficiency.

Figure 16A:
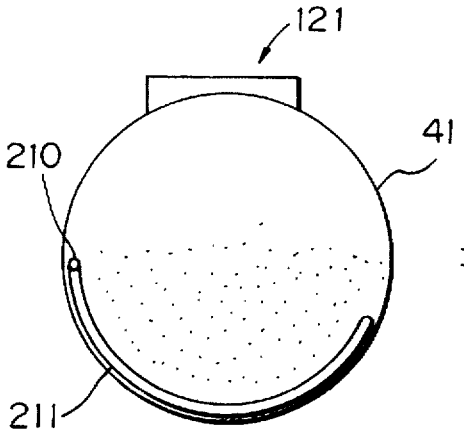
FIGS. 16A–16B show another modified form of the black toner container.
Figure 16B:
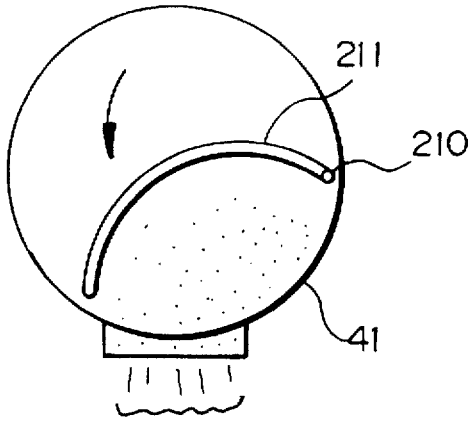
Figure 17A:
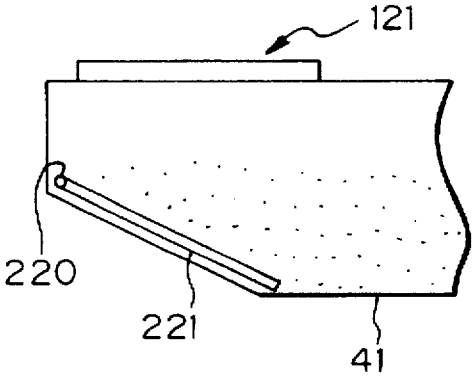
FIGS. 17A and 17B show a further modified form of the black toner container.
Figure 17B:
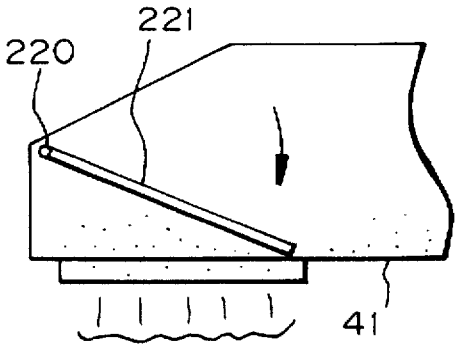

Assume that the operation of the printer is interrupted with the outlet 121 of the container 41 not facing downward and is not used for a long period of time. Then, it is likely that the toner brought to the vicinity of the outlet 121 by the spiral ridge 126 aggregates to form a mass of substantial size and fails, when the outlet 121 faces downward later, to fall via the outlet 121. To obviate this, as shown in FIG. 16A, a member 211 pivotable about a fulcrum 210 may be disposed in the container 41. As shown in FIG. 16B, when the outlet 121 faces downward due to the rotation of the revolver, the member 211 pivots toward the outlet 121 due to gravity while loosening the mass of the toner and forcing it into the outlet 121. FIGS. 17A and 17B show an alternative member 220 which is pivotable about a fulcrum 220 perpendicular to the axis of rotation of the revolver. As shown in FIGS. 16A and 17A, it is preferable that the pivotable members 211 and 221 are positioned, when the outlet 121 does not face upward, along the inner surface of the container 41 in order to ensure a space between them and the outlet 121.

In the illustrative embodiment, the container 41 is set by the set rotation. Alternatively, an arrangement may be made such that the container 41 is set simply by being slid into the revolver. For example, a mount portion similar to the mount portions assigned to the color toner containers 42–44 is provided to allow the container 41 to be slid into the storing unit 45. A collar portion engageable with the mount portion is formed on the container 41 in the vicinity of the edge portion of the outlet 121. To mount the container 41, it is slid into the storing unit 45 with the collar portion engaging with the mount portion. After the container 41 has reached a predetermined position, the seal member is removed from the outlet 121. Again, it is preferable to taper the collar portion of the container 41 and the mount portion for the container 41 in the previously stated configuration.

A controller built in the printer body may control the revolver motor such that the revolver is rotated only for replenishing the black toner into the receptacle 110 while the image forming operation is not under way. In this case, the revolver may be so rotated as to implement a higher toner replenishing efficiency than during image formation, thereby enhancing the efficient supply of the toner from the container 41 to the receptacle 110. Further, while image formation is under way, the revolver may be moved to the developing position in a minimum necessary time without taking account of the replenishment of the toner into the receptacle 110. This successfully reduces the image forming time.

If desired, the revolver may be moved at a lower speed during the toner replenishing operation described above than during the usual image forming operation. In this case, the revolver stays at the replenishing position of FIG. 10D for a longer period of time and, therefore, replenishes the toner into the case 110 efficiently. Further, in the event of the toner replenishing operation, the revolver may even be stopped at the position of FIG. 10D for a preselected period of time so as to further promote the efficient toner replenishment. By so stopping the revolver, it is possible to replenish a great amount of toner into the receptacle 110 by a small number of rotations. Experiments showed that when the revolver is stopped every 90 degrees of movement, as shown in FIGS. 10A–10E, the toner replenishment into the receptacle 110, i.e., the toner replenishing efficiency into the chamber is increased.

During the toner replenishing operation, the revolver may be brought to the replenishing position twice or more. Then, even when the replenishment into the receptacle 110 implemented by a single arrival of the revolver at the replenishing position is short, a desired amount of toner can be supplied to the receptacle 110. Specifically, as shown in FIGS. 6A and 6B, the black toner container 41 has the outlet 121 at one end portion of the circumferential wall, and has the spiral ridge 126 extending from the other end to the outlet 121. When the container 41 is rotated integrally with the revolver, the toner is driven toward the outlet 121. However, it sometimes occurs that when the revolver is brought to the replenishing position only once, the toner in the container 41 cannot be conveyed to the outlet 121. Rotating the revolver twice or more, i.e., bringing it to the replenishing position twice or more is successful to replenish a desired amount of toner into the receptacle 110.

A sensor responsive to the toner concentration in the container 41 may be used. Then, the controller will control the rotation of the motor, i.e., the revolver in response to the output of the sensor during the toner replenishing operation. This allows a necessary amount of toner to be replenished into the receptacle on the basis of toner concentration, thereby maintaining an adequate image density. Even when the output of the sensor is indicative of a toner end level, the controller may not determined that the toner has ended, but it may execute the toner replenishing operation by controlling the rotation of the revolver. Then, even when a monocolor image having a broad image area, for example, is printed, the controller is capable of ensuring an adequate image density without detecting a toner end condition by accident.

In summary, it will be seen that the present invention provides a developing device and a toner container therefor having various unprecedented advantages, as enumerated below.

(1) The edge portion of a toner outlet formed in the toner container and that of a container mount portion formed in the device body are each provided with a predetermined tapered configuration. When the container is fully slid into the mount portion, a sufficient contact pressure is set up between the container and the mount portion and prevents toner from flying about. The two edge portions do not contact or lightly contact up to the time immediately before they align with each other. This obviates a heavy load on the sliding movement and prevents seal members adhered to the edge portions from wearing rapidly.

(2) When the container is fully rotated to bring the edge portion of the outlet into alignment with the edge portion of the mount portion, a sufficient contact pressure is set up between the two edge portions and prevents toner from flying about. The two edge portions do not contact or lightly contact up to the time immediately before they align with each other. This obviates a heavy load on the rotation of the container and prevents seal members adhered to the edge portions from wearing rapidly.

(3) The inner periphery of the container has part thereof adjoining the upstream side of the edge portion in the direction of rotation of the container jutted into the container. The jutted part guides the toner flown down along the inner surface of the container and rushed past the outlet again into the outlet. Otherwise, this part of the toner stays in the container until the outlet again faces downward due to the rotation of the container. The jut, therefore, allows the toner to be efficiently discharged from the container while the container is in rotation.

(4) When the outlet faces downward due to the rotation of the container, a pivotable plate approaches the outlet due to its own weight. Hence, even when the container is left with the outlet facing upward for a long period of time and causes the toner to aggregate, the plate loosens the toner and thereby allows it to be efficiently discharged.

(5) Before a hopper portion arrives at a toner replenishing position, toner around the inlet of the hopper moves to another position in the hopper due to its own weight. At the replenishing position, fresh toner is replenished from the container into the hopper portion in a desirable manner.

(6) A shutter member selectively opens or closes the inlet of the hopper portion due to its own weight during the course of the above movement. At least in a range of movement in which the inlet is located at a higher level than the outlet and apt to cause the toner to flow reversely into the container due to gravity, the shutter member closes the inlet. This promotes efficient toner replenishment from the container into the hopper portion.

(7) At least at the replenishing position, the shutter member opens the inlet to implement toner replenishment from the container into the hopper portion. As a result, the supply of toner from the container to the hopper portion is ensured.

(8) A weight is affixed to the shutter member in order to guarantee the movement of the shutter member.

(9) The shutter member has a shape complementary to the shape of the inner periphery of the hopper and, therefore, closely contacts the edge portion of the inlet to enhance the sealing effect.

(10) In a preselected range of movement including the replenishing position, the direction of rotation is switched at least one. This allows the toner to be transferred from the container to the hopper portion concentratedly.

(11) A plurality of toner outlets and a plurality of toner inlets are respectively formed in the circumferential wall of the container and the inner circumferential wall of the hopper portion which surrounds the former. While the developing chamber, container and hopper portion are rotated about a predetermined axis, the inlets and outlets pass through the replenishing position. Hence, the toner transfer efficiency from the container to the hopper portion is enhanced, compared to the case where only a single inlet and outlet pair is used.

(12) The developing chamber, container and hopper portion are moved only for replenishing the toner into the hopper portion while image formation is not under way. Hence, the toner replenishing efficiency is higher during such a replenishing operation than during the usual image forming operation. During the image forming operation, the chamber, container and hopper can be brought to the developing position in a minimum necessary time without taking account of the toner replenishment into the hopper, thereby reducing the image forming time.

(13) During the toner replenishing operation, the chamber, container and hopper are moved at a lower speed than during the image forming operation. This allows them to stay at the replenishing position for a longer period of time and thereby enhances the replenishing efficiency.

(14) During the toner replenishing operation, the chamber, container and hopper are stopped at the replenishing position for a preselected period of time in order to further promote efficient toner replenishment.

(15) during the toner replenishing operation, the chamber, container and hopper portion are brought to the replenishing position twice or more. Hence, even when the toner replenished when they arrived at the replenishing position once was short, a desired amount of toner can be supplied.

(16) While a sensor senses the amount of toner in the chamber, a controller controls, based on the output of the sensor, the movement of the chamber, container and hopper portion caused by a drive source during the course of the replenishing operation. This allows a necessary amount of toner to be replenished into the hopper portion on the basis of the toner concentration in the chamber, thereby maintaining an adequate image density.

(17) Even if the output of the sensor is indicative of a usual toner end level, the controller neglects it if the chamber, container and hopper portion have not arrived at the replenishing position a predetermined number of times. Then, the controller controls the movement caused by the drive source during the course of the replenishing operation. The controller, therefore, does not detect a toner end condition erroneously even when, for example, a monocolor image having a broad image area is formed, thereby maintaining an adequate image density.

Various modifications will become possible for those skilled in the art after receiving the teachings of the present disclosure without departing from the scope thereof.

What is claimed is:

1. In a developing device comprising a toner container mounted and dismounted from a mount portion included in a body of said developing device by being slid, and storing toner to be replenished into a developing chamber, a portion of said toner container engageable with said mount portion and said mount portion are each tapered in a direction in which said toner container is slid into said mount portion, such that said tapers engage one another along a substantial portion of the length of said tapers.

2. In a toner container storing toner to be replenished into a developing chamber of a developing device, and mounted and dismounted from a mount portion of a body of said developing device by being slid, a portion of said toner container engageable with said mount portion is tapered in a direction in which said toner container is slid into said mount portion, such that said tapers engage one another along a substantial portion of the length of said tapers.

3. In a developing device comprising a toner container storing toner to be replenished into a developing chamber of said developing device, and removable from a body of said developing device, said toner container is configured such that after said toner container has been mounted to a mount portion of said body, said toner container is rotated to bring a toner outlet thereof into alignment with a toner inlet formed in said mount portion, and an edge portion of said toner outlet is tapered to progressively approach an edge portion of said toner inlet due to a rotation of said toner container.

4. In a toner container storing toner to be replenished into a developing chamber of a developing device, and rotated, after being mounted to a mount portion of a body of said developing device, to bring a toner outlet thereof into alignment with a toner inlet formed in said mount portion, an edge portion of said toner outlet is tapered to progressively approach an edge portion of said toner inlet due to a rotation of said toner container.

5. In a developing device comprising a toner container mounted and dismounted from a mount portion included in a body of said developing device by being slid, and storing toner to be replenished into a developing chamber, a portion of said toner container engageable with said mount portion and said mount portion are each tapered in a direction in which said toner container is slid into said mount portion, wherein said tapered portion of said toner container is at an edge of an opening of said toner container.

6. In a toner container storing toner to be replenished into a developing chamber of a developing device, and mounted and dismounted from a mount portion of a body of said developing device by being slid, a portion of said toner container engageable with said mount portion is tapered in a direction in which said toner container is slid into said mount portion, wherein said tapered portion of said toner container is at an edge of an opening of said toner container.

* * * * *